US009897335B2

(12) United States Patent
Nouchi

(10) Patent No.: US 9,897,335 B2
(45) Date of Patent: Feb. 20, 2018

(54) INDOOR UNIT OF AIR CONDITIONING APPARATUS

(75) Inventor: Yoshiteru Nouchi, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 871 days.

(21) Appl. No.: 13/504,604

(22) PCT Filed: Oct. 28, 2010

(86) PCT No.: PCT/JP2010/069168

§ 371 (c)(1),
(2), (4) Date: Apr. 27, 2012

(87) PCT Pub. No.: WO2011/055677

PCT Pub. Date: May 12, 2011

(65) Prior Publication Data

US 2012/0225618 A1 Sep. 6, 2012

(30) Foreign Application Priority Data

Nov. 5, 2009 (JP) ..... 2009-254309

(51) Int. Cl.
*F24F 13/14* (2006.01)
*F24F 1/00* (2011.01)
(Continued)

(52) U.S. Cl.
CPC ..... *F24F 1/0011* (2013.01); *F24F 11/0078* (2013.01); *F24F 2001/0037* (2013.01); *F24F 2013/221* (2013.01)

(58) Field of Classification Search
CPC ..... F24F 1/0011; F24F 1/0003; F24F 11/0078
See application file for complete search history.

(56) References Cited

U.S. PATENT DOCUMENTS 5,577,958 A * 11/1996 Kumekawa et al. ..... 454/233
6,450,880 B1 * 9/2002 Asahina ..... F24F 1/0011 454/233

(Continued)

FOREIGN PATENT DOCUMENTS

EP 1 319 900 A1 6/2003
EP 1 884 718 A2 2/2008

(Continued)

OTHER PUBLICATIONS

JP 2516786 Y2 English machine translation, Aug. 20, 1996.*

(Continued)

*Primary Examiner* — Alissa Tompkins
*Assistant Examiner* — Phillip E Decker
(74) *Attorney, Agent, or Firm* — Global IP Counselors, LLP

(57) ABSTRACT

An indoor unit of an air conditioning apparatus is fixed with respect to a ceiling, and includes an indoor unit casing having an air inlet and plural air outlets, plural airflow direction adjusting plates disposed in the air outlets, and an airflow direction adjusting control unit to independently adjust rotational states of the adjusting plates in order to adjust the airflow direction of conditioned air blown out from the air outlets. The control unit causes an entire body of at least one of the adjusting plates to be positioned inside a corresponding one of the air outlets in an air volume reducing state to reduce volume through the air outlet or a suppressing state to suppress flow from the air outlet toward an opposite side relative to an air inlet side.

13 Claims, 15 Drawing Sheets

(51) Int. Cl.
*F24F 11/00* (2018.01)
*F24F 13/22* (2006.01)

(56) References Cited

U.S. PATENT DOCUMENTS

| | | | | |
|---|---|---|---|---|
| 6,598,413 | B2 * | 7/2003 | Asahina et al. | 62/298 |
| 8,511,108 | B2 * | 8/2013 | Yabu | F24F 1/0011 165/53 |
| 9,441,842 | B2 * | 9/2016 | Nouchi | F24F 1/0014 |
| 9,618,260 | B2 * | 4/2017 | Kang | F25D 27/005 |
| 2002/0177400 | A1 * | 11/2002 | Asahina | F24F 1/0011 454/233 |
| 2004/0050077 | A1 * | 3/2004 | Kasai | F24F 1/0011 454/292 |
| 2006/0213216 | A1 * | 9/2006 | Sakashita et al. | 62/419 |
| 2006/0276123 | A1 * | 12/2006 | Sanagi | F24F 1/0011 454/292 |
| 2008/0034775 | A1 * | 2/2008 | Choi | F24F 1/0011 62/259.1 |
| 2008/0254734 | A1 * | 10/2008 | Uenaka et al. | 454/256 |
| 2009/0095008 | A1 * | 4/2009 | Yabu | F24F 1/0011 62/259.1 |
| 2009/0098820 | A1 * | 4/2009 | Yabu | 454/333 |
| 2010/0036533 | A1 * | 2/2010 | Masuda et al. | 700/278 |
| 2012/0015599 | A1 * | 1/2012 | Nouchi | 454/251 |
| 2012/0214398 | A1 * | 8/2012 | Nouchi | 454/256 |
| 2012/0288363 | A1 * | 11/2012 | Yumoto et al. | 415/182.1 |
| 2015/0007967 | A1 * | 1/2015 | Jeong et al. | 165/121 |
| 2015/0253032 | A1 * | 9/2015 | Kono | F24F 13/14 165/177 |
| 2016/0258649 | A1 * | 9/2016 | Tanaka | F24F 1/0014 |

FOREIGN PATENT DOCUMENTS

| | | | | |
|---|---|---|---|---|
| EP | 2 031 320 | A1 | | 3/2009 |
| JP | 4-110335 | U | | 9/1992 |
| JP | 2516786 | Y2 | * | 8/1996 |
| JP | 10-148345 | A | | 6/1998 |
| JP | 10-246502 | A | | 9/1998 |
| JP | 2001-147041 | A | * | 5/2001 |
| JP | 2002-349892 | A | | 12/2002 |
| JP | 2006-336925 | A | | 12/2006 |
| JP | 2007-285652 | A | * | 11/2007 |
| JP | 2007-285652 | A | | 11/2007 |
| JP | 2008-232470 | A | | 10/2008 |
| JP | 4495778 | B1 | | 4/2010 |

OTHER PUBLICATIONS

European Search Report of corresponding EP Application No. 10 82 8237.7 dated Oct. 16, 2013.

International Preliminary Report of corresponding PCT Application No. PCT/JP2010/069168 dated Jun. 21, 2012.

International Search Report of corresponding PCT Application No. PCT/JP2010/069168 dated Feb. 1, 2011.

International Preliminary Report of corresponding PCT Application No. PCT/JP2010/069168.

International Search Report of corresponding PCT Application No. PCT/JP2010/069168.

* cited by examiner

INDOOR UNIT OF AIR CONDITIONING APPARATUS

CROSS-REFERENCE TO RELATED APPLICATIONS

This U.S. National stage application claims priority under 35 U.S.C. § 119(a) to Japanese Patent Application No. 2009-254309, filed in Japan on Nov. 5, 2009, the entire contents of which are hereby incorporated herein by reference.

TECHNICAL FIELD

The present invention relates to an indoor unit of an air conditioning apparatus.

BACKGROUND ART

As an indoor unit of an air conditioning apparatus, there is, as described in Japanese Patent Publication No. 2002-349892 for example, an indoor unit of an air conditioning apparatus where plural air outlets are disposed. In this indoor unit of an air conditioning apparatus, a wide range of a target space can be conditioned by conditioned air blown out from each of the plural air outlets.

However, in the indoor unit of an air conditioning apparatus of Japanese Patent Publication No. 2002-349892, in a case where the target area to which the conditioned air from a predetermined air outlet is to be blown out is near a side wall in a room or in a case where there is a user who dislikes the sensation of a draft, a closing member or the like becomes separately necessary in order to keep the extent to which the air is blown out from that air outlet low or stop it.

With respect to this, in an indoor unit of an air conditioning apparatus described in Japanese Patent Publication No. 2007-285652, there is proposed a technology that reduces the volume of conditioned air blown out from a specific air outlet by causing a horizontal flap that adjusts the airflow direction of the conditioned air to rotate to block the entire air outlet.

SUMMARY

Technical Problem

However, in the indoor unit of the air conditioning apparatus described in Japanese Patent Publication No. 2007-285652, it is difficult to completely block the air outlet with the horizontal flap, and it is easy for a temperature difference to arise between the surface of the horizontal flap that the conditioned air strikes and the surface of the horizontal flap on the room side that air whose temperature has not been adjusted strikes. When a temperature difference arises between one surface and the opposite surface of the horizontal flap in this way, it ends up becoming easier for dew condensation to form on the front surface of the horizontal flap.

The present invention has been made in view of the above-described circumstances, and it is a problem of the present invention to provide an indoor unit of an air conditioning apparatus that can decrease the volume of air blown out from any air outlet of plural air outlets while suppressing dew condensation without using a new part.

Solution to Problem

An indoor unit of an air conditioning apparatus of a first aspect of the invention is an indoor unit of an air conditioning apparatus that is fixed with respect to a ceiling, the indoor unit including an indoor unit casing, airflow direction adjusting plates, and an airflow direction adjusting control unit. The indoor unit casing has an air inlet and plural air outlets. The plural airflow direction adjusting plates are disposed in the air outlet respectively. The airflow direction adjusting plates can, by rotating, adjust the airflow direction of conditioned air blown out from the air outlet respectively. The airflow direction adjusting control unit can independently adjust the rotational states of the plural airflow direction adjusting plates respectively. The airflow direction adjusting control unit causes the entire body of at least any one of the plural airflow direction adjusting plates to be positioned inside the corresponding air outlet to thereby put the airflow direction adjusting plate in an air volume reducing state in which the airflow direction adjusting plate reduces the volume of the conditioned air passing through the air outlet or a suppressing state in which the airflow direction adjusting plate suppresses the flow of the conditioned air heading from the air outlet toward the opposite side of the air inlet side.

In this indoor unit of an air conditioning apparatus, it becomes possible to reduce the volume of air blown out from any air outlet of the plural air outlets while suppressing dew condensation without using a new part.

An indoor unit of an air conditioning apparatus of a second aspect of the invention is the indoor unit of an air conditioning apparatus of the first aspect of the invention and further includes arm members. The airflow direction adjusting plates are placed away from rotating shafts in the rotation. The arm members extend from the airflow direction adjusting plates to the rotating shafts.

In this indoor unit of an air conditioning apparatus, the airflow direction adjusting plates are placed away from the rotating shafts, so it becomes possible to change, by rotation, position in the flow direction of the conditioned air in the air outlets.

An indoor unit of an air conditioning apparatus of a third aspect of the invention is the indoor unit of an air conditioning apparatus of the first or second aspect of the invention, wherein the airflow direction adjusting plates have dew condensation suppressing surfaces that have a dew condensation suppressing function as a result of having a groove shape formed therein or being flocked. Back surfaces of the dew condensation suppressing surfaces of the airflow direction adjusting plates have a flatter shape than the dew condensation suppressing surfaces.

In this indoor unit of an air conditioning apparatus, the formation of dew condensation can be suppressed by the dew condensation suppressing surfaces of the airflow direction adjusting plates. Further, the back surfaces of the dew condensation suppressing surfaces have a flat shape, so by putting these surfaces in a state in which they face the room side, the design can be improved. For this reason, it becomes possible to achieve a balance, simply by changing the rotational states of the airflow direction adjusting plates, between suppressing dew condensation on the airflow direction adjusting plates and improving the design when seen from the room side.

An indoor unit of an air conditioning apparatus of a fourth aspect of the invention is the indoor unit of an air conditioning apparatus of the third aspect of the invention, wherein the dew condensation suppressing surface sides of the airflow direction adjusting plates have a concave shape, and the back surface sides of the dew condensation suppressing surfaces of the airflow direction adjusting plates have a convex shape.

In this indoor unit of an air conditioning apparatus, in the case of adjusting the airflow direction with the airflow direction adjusting plates, the conditioned air passing through the air outlets can be gently guided in the traveling direction, and in the case of reducing the air volume in the air outlets, it becomes possible to suppress the extent of turbulence in the traveling direction of the conditioned air.

An indoor unit of an air conditioning apparatus of a fifth aspect of the invention is the indoor unit of an air conditioning apparatus of any of the first to fourth aspects of the invention, wherein the indoor unit is equipped with at least four sets of the airflow direction adjusting plates and the air outlets. The number of sets on which the airflow direction adjusting control unit can simultaneously execute the air volume reducing state is only one set or two sets of the four sets.

In the indoor unit of an air conditioning apparatus of the first to fourth aspects, if the air volume reducing state ends up being simultaneously performed in three or more sets of the four sets of the air outlets and the airflow direction adjusting plates, the volume of air passing through the section of the remaining set of the air outlets and the airflow direction adjusting plates ends up increasing too much.

With respect to this, in the indoor unit of an air conditioning apparatus of the fifth aspect, the number of sets on which the air volume reducing state can be simultaneously executed is restricted to two sets or less, so it becomes possible to suppress an excessive increase in the volume of air blown out from the section not taking the air volume reducing state.

Advantageous Effects of Invention

In the indoor unit of an air conditioning apparatus of the first aspect of the invention, it becomes possible to reduce the volume of air blown out from any air outlet of the plural air outlets while suppressing dew condensation without using a new part.

In the indoor unit of an air conditioning apparatus of the second aspect of the invention, it becomes possible to change, by rotation, position in the flow direction of the conditioned air in the air outlets.

In the indoor unit of an air conditioning apparatus of the third aspect of the invention, it becomes possible to achieve a balance, simply by changing the rotational states of the airflow direction adjusting plates, between suppressing dew condensation on the airflow direction adjusting plates and improving the design when seen from the room side.

In the indoor unit of an air conditioning apparatus of the fourth aspect of the invention, it becomes possible to selectively perform: moderately and gently guiding, in the traveling direction, the conditioned air passing through the air outlets; and reducing the air volume while suppressing the extent of turbulence in the traveling direction of the conditioned air.

In the indoor unit of an air conditioning apparatus of the fifth aspect of the invention, it becomes possible to suppress an excessive increase in the volume of air blown out from the section not taking the air volume reducing state.

DESCRIPTION OF EMBODIMENT

A ceiling-mounted air conditioning apparatus pertaining to an embodiment of the present invention will be described below with reference to the drawings.

<1> Air Conditioning Apparatus 1

Figure 1:
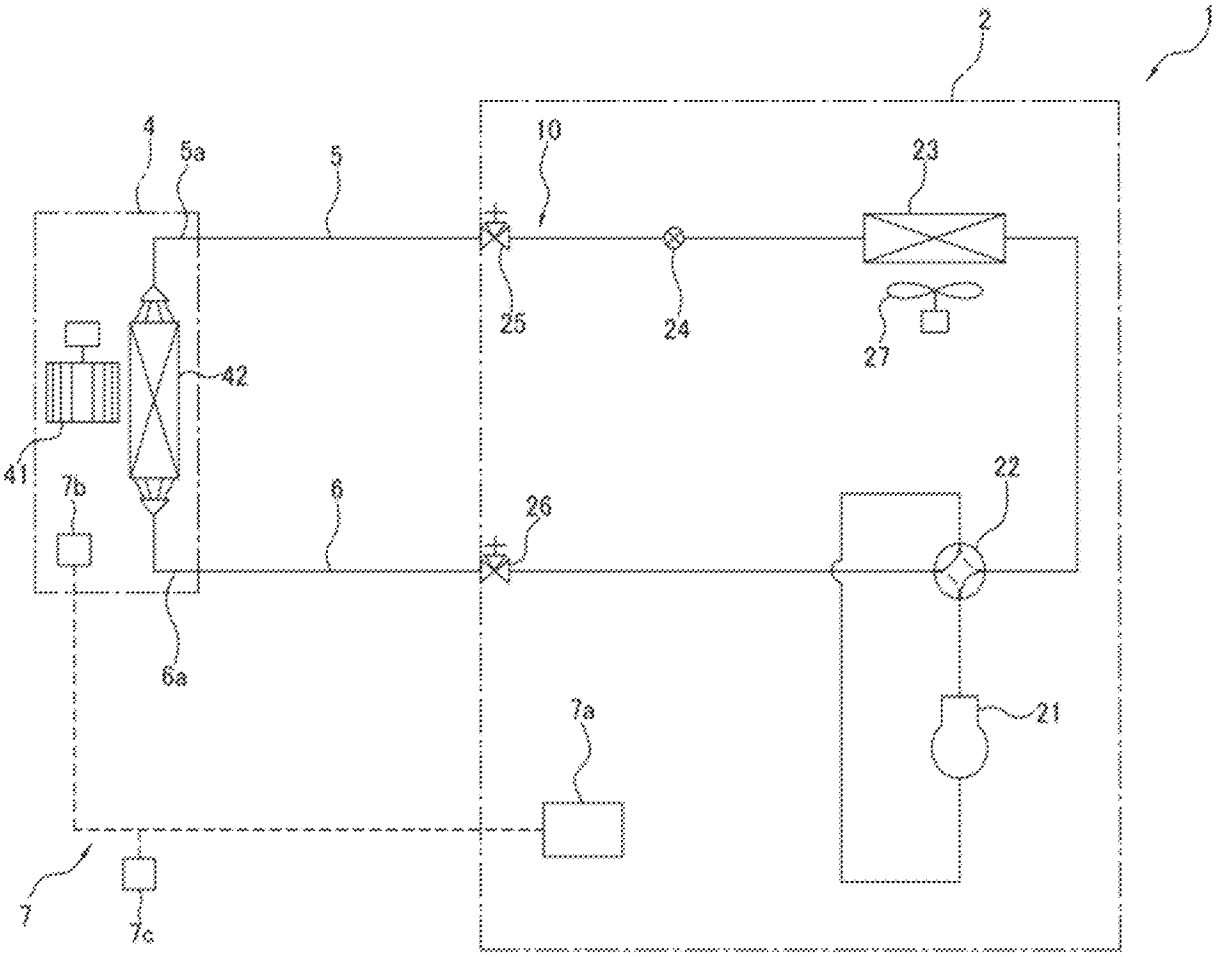
FIG. 1 is a schematic diagram of a refrigerant circuit showing a cooling operation state of an air conditioning apparatus pertaining to an embodiment of the present invention.

FIG. 1 is a schematic configuration diagram of an air conditioning apparatus 1 in which an indoor unit pertaining to the embodiment of the present invention is employed.

The air conditioning apparatus 1 is a type that is installed as a result of a type of indoor unit being embedded in a ceiling, has eight air outlets, and can independently rotate and control, per airflow direction adjusting plate, the angles of inclination of airflow direction adjusting plates disposed in four of the eight air outlets. The air conditioning apparatus 1 is a split type of air conditioning apparatus, mainly has an outdoor unit 2, an indoor unit 4, a liquid refrigerant connection tube 5 and a gas refrigerant connection tube 6 that interconnect the outdoor unit 2 and the indoor unit 4, and a control unit 7, and configures a vapor compression refrigerant 10.

<1-1> Outdoor Unit 2

The outdoor unit 2 is installed outdoors or the like and mainly has a compressor 21, a four-way switching valve 22, an outdoor heat exchanger 23, an expansion valve 24, a liquid-side stop valve 25, a gas-side stop valve 26, and an outdoor fan 27.

The compressor 21 is a compressor for sucking in low-pressure gas refrigerant, compressing the low-pressure gas refrigerant into high-pressure gas refrigerant, and thereafter discharging the high-pressure gas refrigerant.

The four-way switching valve 22 is a valve for switching the direction of the flow of the refrigerant when switching between cooling and heating. During cooling, the four-way switching valve 22 can interconnect the discharge side of the compressor 21 and the gas side of the outdoor heat exchanger 23 and also interconnect the gas-side stop valve 26 and the suction side of the compressor 21 (refer to the solid lines of the four-way switching valve 22 in FIG. 1). Further, during heating, the four-way switching valve 22 can interconnect the discharge side of the compressor 21 and the gas-side stop valve 26 and also interconnect the gas side of the outdoor heat exchanger 23 and the suction side of the compressor 21 (refer to the broken lines of the four-way switching valve 22 in FIG. 1).

The outdoor heat exchanger 23 is a heat exchanger that functions as a condenser of the refrigerant during cooling and functions as an evaporator of the refrigerant during heating. The liquid side of the outdoor heat exchanger 23 is connected to the expansion valve 24, and the gas side of the outdoor heat exchanger 23 is connected to the four-way switching valve 22.

The expansion valve 24 is a motor-driven expansion valve which, before sending the refrigerant to an indoor heat exchanger 42 (described later), can reduce the pressure of the high-pressure liquid refrigerant that has been condensed in the outdoor heat exchanger 23 during cooling and which, before sending the refrigerant to the outdoor heat exchanger 23, can reduce the pressure of the high-pressure liquid refrigerant that has been condensed in the indoor heat exchanger 42 during heating.

The liquid-side stop valve 25 and the gas-side stop valve 26 are valves disposed in openings that connect to external devices and pipes (specifically, the liquid refrigerant connection tube 5 and the gas refrigerant connection tube 6). The liquid-side stop valve 25 is connected to the expansion valve 24. The gas-side stop valve 26 is connected to the four-way switching valve 22.

The outdoor fan 27 is placed inside the outdoor unit 2 and forms an airflow that sucks in outdoor air, supplies the outdoor air to the outdoor heat exchanger 23, and thereafter discharges the outdoor air to the outside of the unit. For this reason, the outdoor heat exchanger 23 has the function of using the outdoor air as a cooling source or a heating source to condense and evaporate the refrigerant.

<1-2> Indoor Unit 4

In the present embodiment, the indoor unit 4 is a type of ceiling-mounted air conditioning apparatus indoor unit called a ceiling-embedded type and has an indoor unit casing 31, an indoor fan 41, an indoor heat exchanger 42, a drain pan 40, a bell mouth 41*c* and other components.

Figure 2:
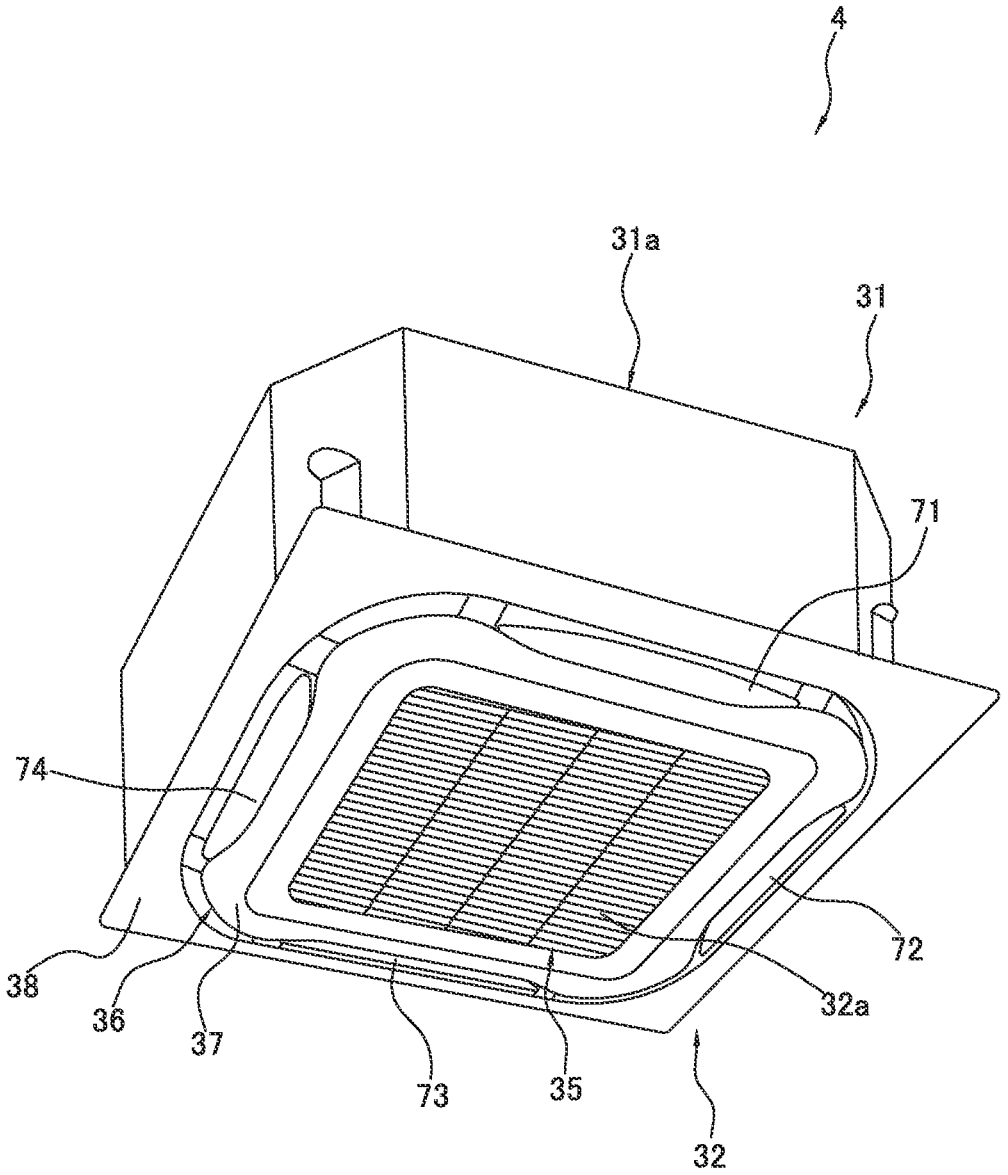
FIG. 2 is an external perspective view of an indoor unit of the air conditioning apparatus.
Figure 3:
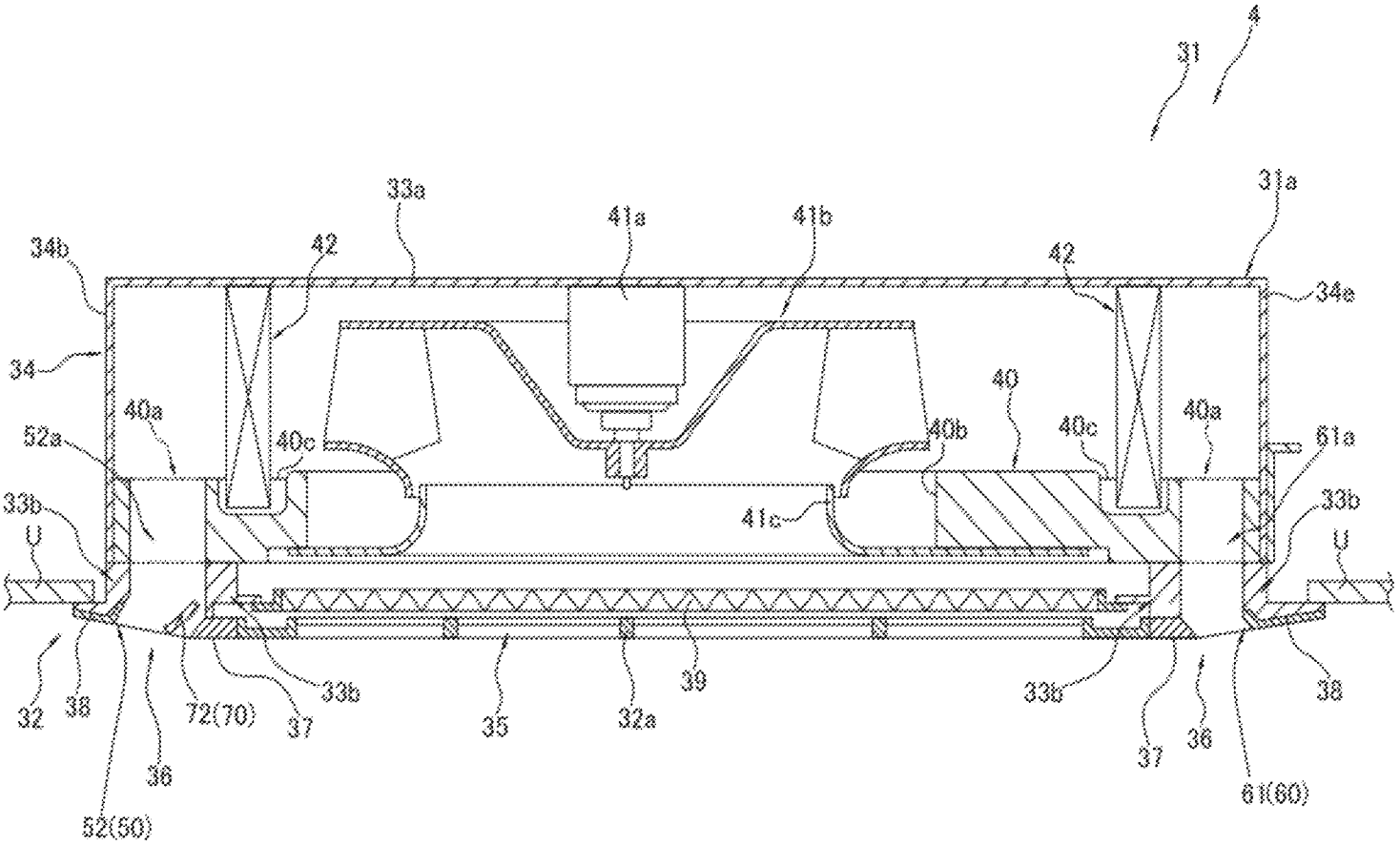
FIG. 3 is a schematic cross-sectional view, in cross section A-O-A in FIG. 4, of the indoor unit of the air conditioning apparatus.
Figure 4:
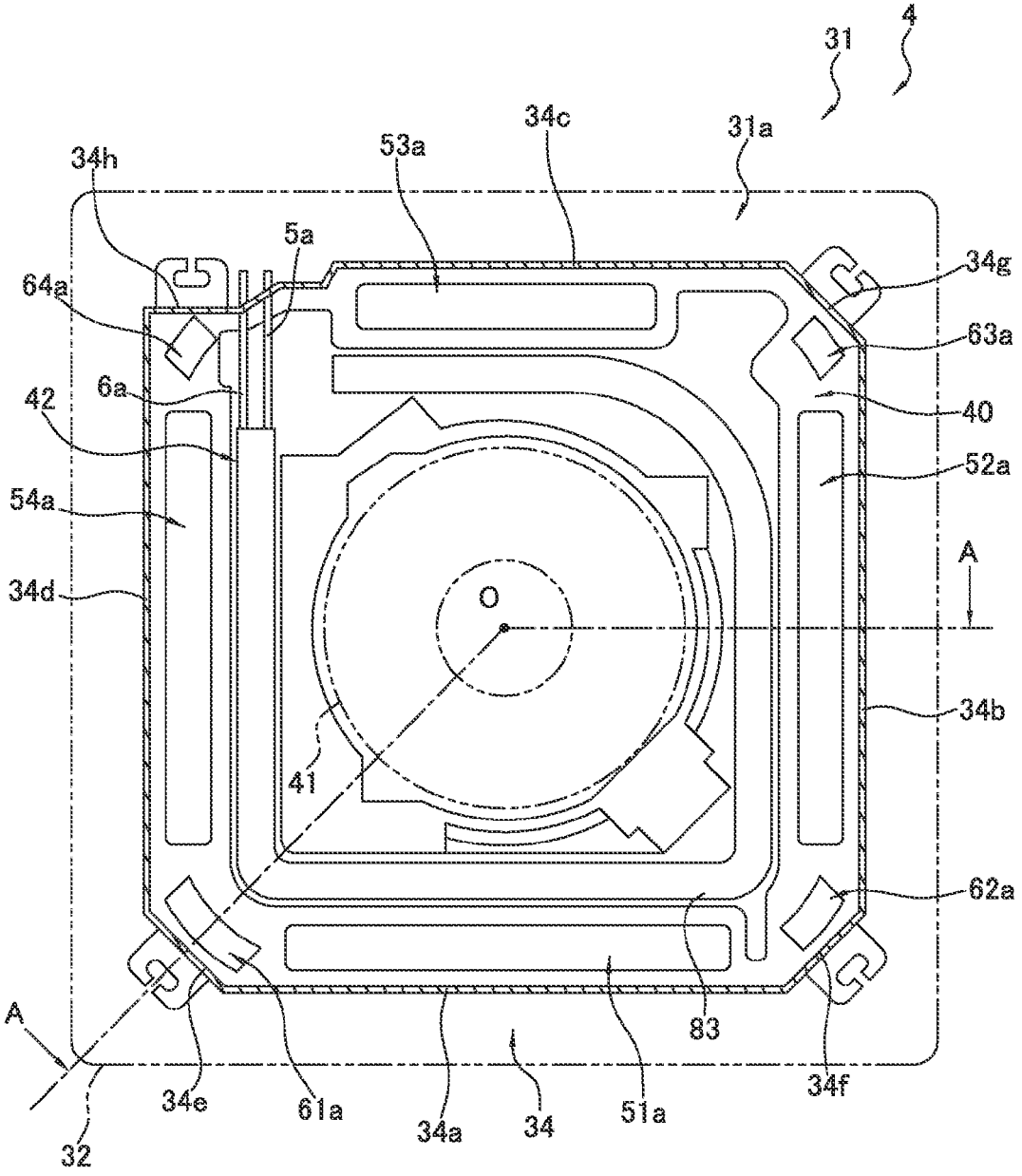
FIG. 4 is a schematic cross-sectional view, as seen from above, of the indoor unit of the air conditioning apparatus.

FIG. 2 is an external perspective view of the indoor unit 4. FIG. 4 is a schematic plan view showing a state where a top plate 33*a* of the indoor unit 4 has been removed. FIG. 3 is a schematic side sectional view of the indoor unit 4 and corresponds to a cross-sectional view in a cross section indicated by A-O-A in FIG. 4.

The indoor unit casing 31 includes a casing body 31*a*, a decorative panel 32, and airflow direction adjusting portions 70.

Figure 6:
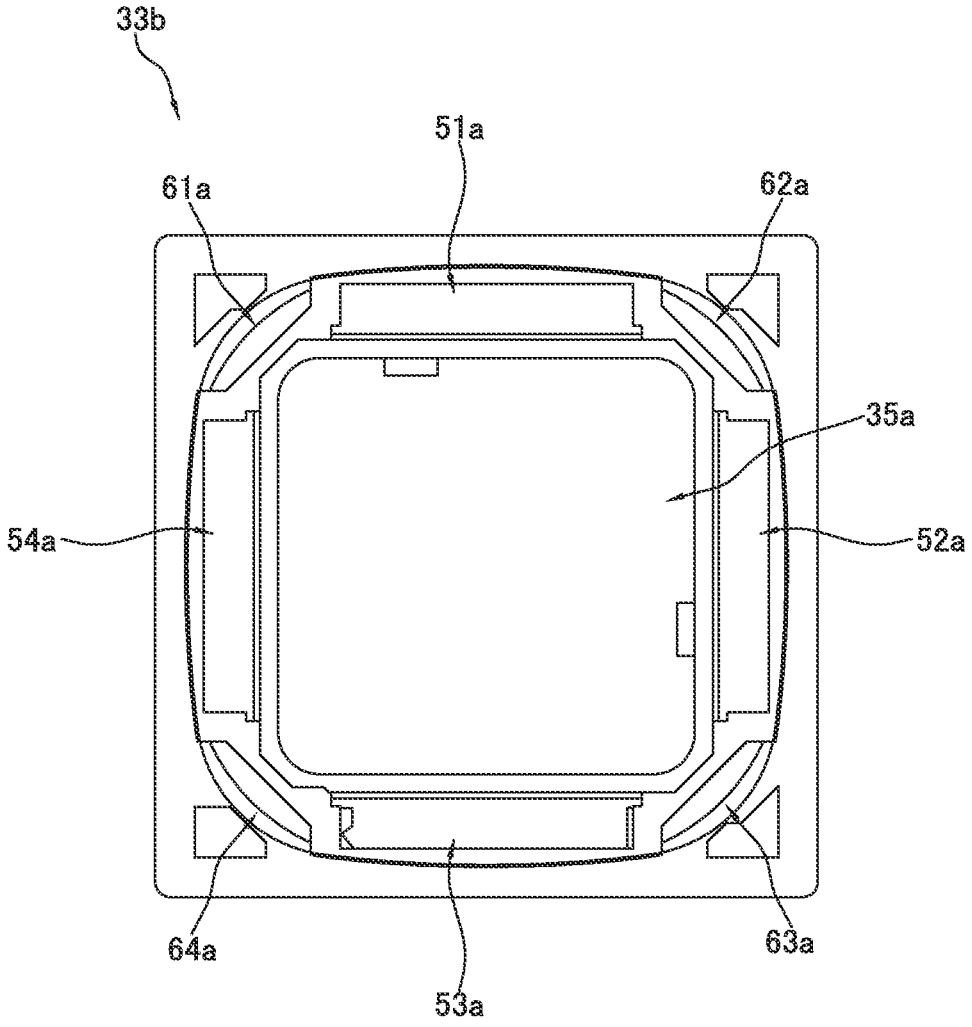
FIG. 6 is an external configuration view, as seen from below, of the indoor unit of the air conditioning apparatus.

As shown in FIG. 3 and FIG. 4, the casing body 31*a* is placed so as to be inserted in an opening formed in a ceiling U of an air-conditioned room. When the casing body 31*a* is seen from above, the casing body 31*a* is a substantially octagonal box-like body in which long sides and short sides are alternately formed, and the lower surface of the casing body 31*a* is open. The casing body 31*a* has a substantially octagonal top plate 33*a* in which long sides and short sides are alternately continuously formed, a side plate 34 that extends downward from the peripheral edge portion of the top plate 33*a*, and a bottom plate 33*b* that supports the top plate 33*a* and the side plate 34 from below. The side plate 34 is configured from side plates 34*a*, 34*b*, 34*c*, and 34*d*, which correspond to the long sides of the top plate 33*a*, and side plates 34*e*, 34*f*, 34*g*, and 34*h*, which correspond to the short sides of the top plate 33*a*. A liquid-side connecting tube 5*a* and a gas-side connecting tube 6*a* for interconnecting the indoor heat exchanger 42 and the refrigerant connection tubes 5 and 6 penetrate the side plate 34*h*. As shown in FIG. 6, which is a bottom view in a state where the decorative panel 32 and other components are not attached, a substantially quadrilateral opening is disposed in the center of the bottom plate 33*b*, plural openings are disposed around that opening, and the bottom plate 33*b* configures a lower surface of the casing body 31*a*. As shown in FIG. 3, the bottom plate 33*b* is formed so as to widen further outward than the top plate 33*a* and the side plate 34, and the decorative panel 32 is attached to the lower surface side (the room side) of the bottom plate 33*b*.

As shown in FIG. 3, FIG. 4, and FIG. 6, inside the easing 31*a* are disposed an air inlet flow path 35*a* for taking in air from an air inlet 35 into the inside of the easing body 31*a* and air outlet flow paths 51*a*, 52*a*, 53*a*, 54*a*, 61*a*, 62*a*, 63*a*, and 64*a* that are placed so as to surround the outside of the air inlet flow path 35*a*, have shapes extending in a substantially vertical direction, and are for blowing out conditioned air into the room.

Figure 5:
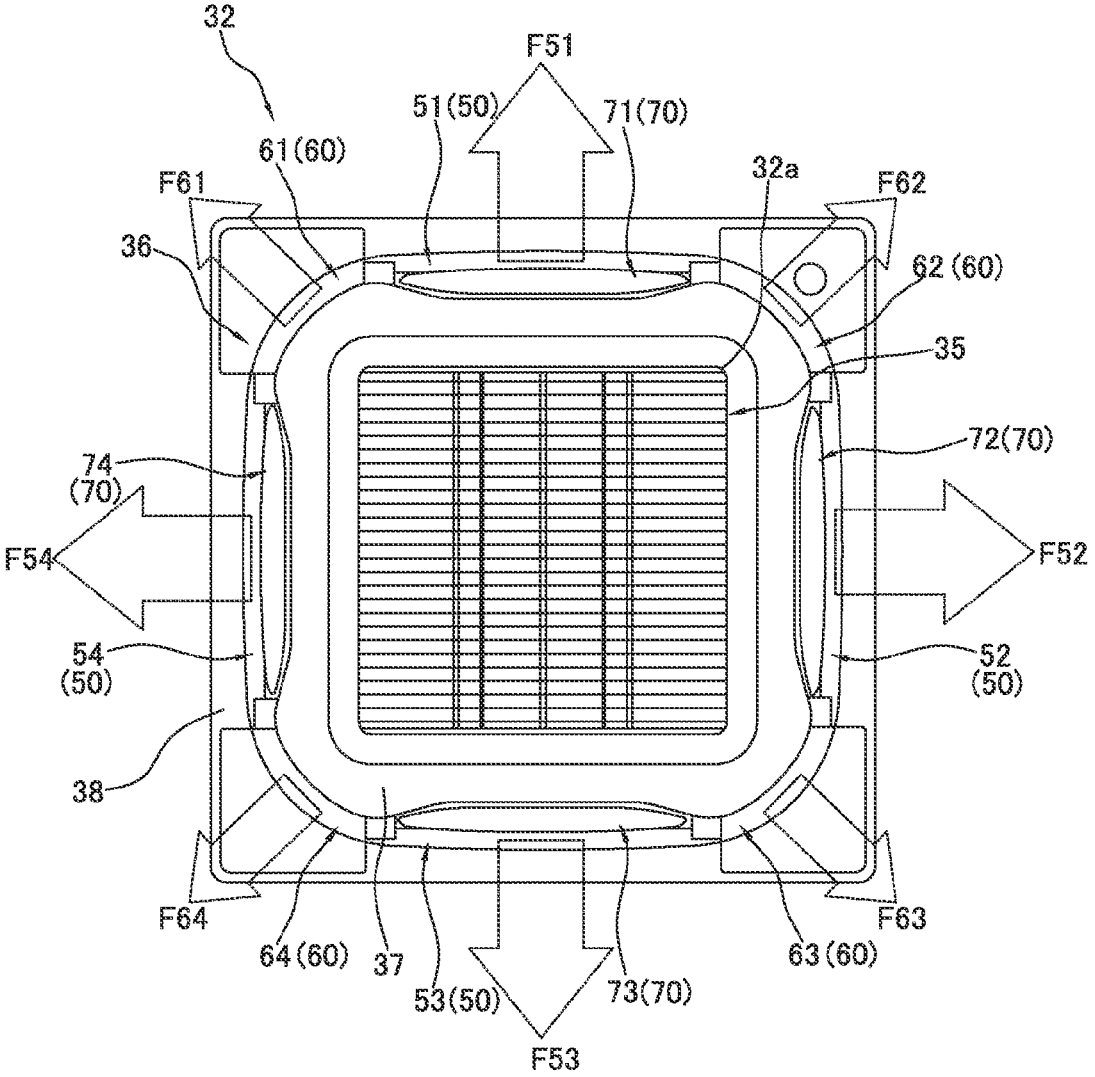
FIG. 5 is an external configuration view, as seen from below, of a bottom plate.

As shown in FIG. 2, FIG. 3, and FIG. 4, the decorative panel 32 is placed so as to be fitted into the opening in the ceiling U. The decorative panel 32 is a plate-like body having a substantially quadrilateral shape as seen from above and is mainly fixed to the lower end portion of the casing body 31*a* as a result of being attached from the room side with respect to the bottom plate 33*b* of the casing body 31*a*. As shown in FIG. 5, which is a bottom view of the indoor unit 4, the decorative panel 32 is configured by a suction grill 32*a*, an inner frame decorative panel 37, and an outer frame decorative panel 38, and has an air inlet 35 and an air outlet 36. In an installed state of the indoor unit 4, the lower end of the inner frame decorative panel 37 is placed so as to be positioned a little lower than the lower end of the outer frame decorative panel 38.

Figure 7:
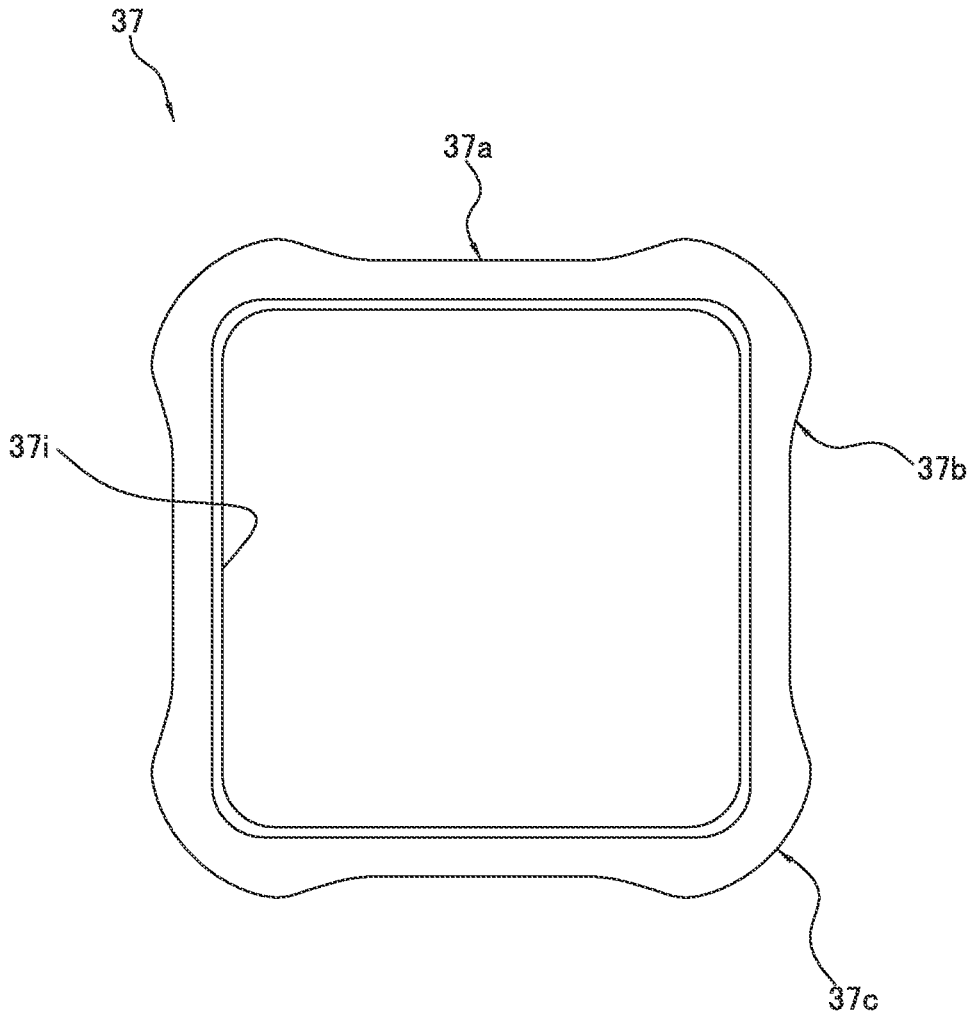
FIG. 7 is an external configuration view, as seen from below, of an inner frame decorative panel.
Figure 8:
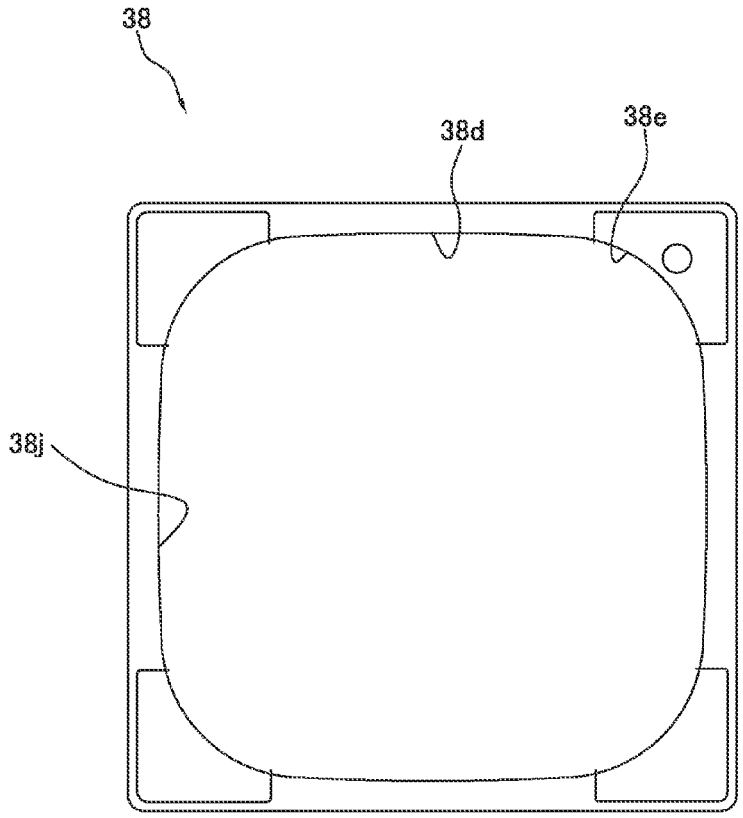
FIG. 8 is a cross-sectional view, as seen from the side, of an airflow direction adjusting portion.

The suction grill 32*a* is a substantially quadrilateral panel placed in the center of the lower surface of the casing body 31*a*. As shown in FIG. 7, which is a bottom view seen from the room side, the inner frame decorative panel 37 is a substantially quadrilateral frame member and is placed between the air inlet 35 and the air outlet 36. An inside edge 37*i* of the inner frame decorative panel 37 is substantially quadrilateral and has a shape whose corner sections are rounded. The outside edge of the inner frame decorative panel 37 includes inner frame air outlet-side linear portions 37*a*, inner frame air outlet-side curved portions 37*b*, and opening-inside bulging portions 37*c*. The inner frame air outlet-side linear portions 37*a* are sections that are disposed in outside positions corresponding to the neighborhoods of the centers of the four sides of the inside edge 37*i*, are substantially parallel to the sides of the inside edge 37*i*, and extend linearly. The inner frame air outlet-side curved portions 37*b* are formed in such a way that their edges are positioned further outward as approaching the corners of the inner frame decorative panel 37. The inner frame air outlet-side curved portions 37*b* have concave shapes recessed smoothly inward. The opening-inside bulging portions 37*c* configure the outer edges in the vicinities of the corners of the inner frame decorative panel 37 and have outwardly bulging shapes whose corners are rounded. The outer frame decorative panel 38 is placed so as to cover the outer edge of the lower surface of the casing body 31*a* and is placed on the outside of the air outlet 36. As shown in FIG. 8, which is a bottom view seen from the room side, an outside edge 38*j* of the outer frame decorative panel 38 is substantially quadrilateral, has a shape following the edge of the bottom plate 33*b* of the casing body 31*a*, and has rounded corners. The inside edge of the outer frame decorative panel 38 includes outer frame air outlet-side linear portions 38*d* and outer frame air outlet-side curved portions 38*e*. The outer frame air outlet-side linear portions 38*d* are sections that are disposed in inside positions corresponding to the neighborhoods of the centers of the four sides of the outside edge 38*j*, are substantially parallel to the sides of the outside edge 38*j*, and extend linearly. The outer frame air outlet-side curved portions 38*e* are formed in such a way that their edges are positioned further inward closer to the corners of the outer frame decorative panel 38. The outer frame air outlet-side curved portions 38*e* have convex shapes that bulge gently outward. The linear sections of the outer frame air outlet-side linear portions 38*d* are formed so as to be shorter than the linear sections of the inner frame air outlet-side linear portions 37*a*, and the percentage of the outer frame air outlet-side curved portions 38*e* in the length along the inner frame is large, so a bottom view of the outer frame air outlet-side linear portions 38*d* and the outer frame air outlet-side curved portions 38*e* shows they have a shape close to that of a circle.

The air inlet 35 is a substantially quadrilateral opening disposed in the substantial center of the suction grill 32*a*. A filter 39 for removing dirt and dust in the air that has been sucked in from the air inlet 35 is disposed in the air inlet 35. The above mentioned air inlet flow path 35*a* leads to the air inlet 35 on the inside of the casing body 31*a*.

The air outlet 36 is disposed between the inner frame decorative panel 37 and the outer frame decorative panel 38 so as to surround the periphery of the air inlet 35 and is configured from long-side air outlets 50 and short-side air outlets 60. The long-side air outlets 50 are configured from four air outlets—a first long-side air outlet 51, a second long-side air outlet 52, a third long-side air outlet 53, and a fourth long-side air outlet 54—that are disposed in positions corresponding to the sides of the substantially quadrilateral shape of the air inlet 35. The long-side air outlets 50 are formed so as to not have edge sections facing the inside of the opening. The long-side air outlets 50 are configured in such a way that the difference in length between their lengthwise direction and their width direction, which is a direction orthogonal to the lengthwise direction, is smaller than in a conventional air outlet (in such a way that the aspect ratio of the lengths is smaller than conventionally), so the initial speed of the airflows blown out from the neighborhoods of the centers of the long-side air outlets 50 can be raised. The short-side air outlets 60 are configured from four air outlets—a first short-side air outlet 61, a second short-side air outlet 62, a third short-side air outlet 63, and a fourth short-side air outlet 64—that are disposed in positions corresponding to the corner sections of the substantially quadrilateral shape of the air inlet 35. The air outlet 36 is configured in such a way that the long-side air outlets 50 and the short-side air outlets 60 are alternately arranged and placed in a substantially annular shape. The first long-side air outlet flow path 51*a*, the second long-side air outlet flow path 52*a*, the third long-side air outlet flow path 53*a*, and the fourth long-side air outlet flow path 54*a* lead respectively to the first long-side air outlet 51, the second long-side air outlet 52, the third long-side air outlet 53, and the fourth long-side air outlet 54. Further, the first short-side air outlet flow path 61*a*, the second short-side air outlet flow path 62*a*, the third short-side air outlet flow path 63*a*, and the fourth short-side air outlet flow path 64*a* lead respectively to the first short-side air outlet 61, the second short-side air outlet 62, the third short-side air outlet 63, and the fourth short-side air outlet 64.

Airflows F51, F52, F53, F54, F61, F62, F63, and F64 that have been conditioned inside the indoor unit 4 are blown out, while having their blow-out direction adjusted, respectively from the first long-side air outlet 51, the second long-side air outlet 52, the third long-side air outlet 53, the fourth long-side air outlet 54, the first short-side air outlet 61, the second short-side air outlet 62, the third short-side air outlet 63, and the fourth short-side air outlet 64.

Figure 9:
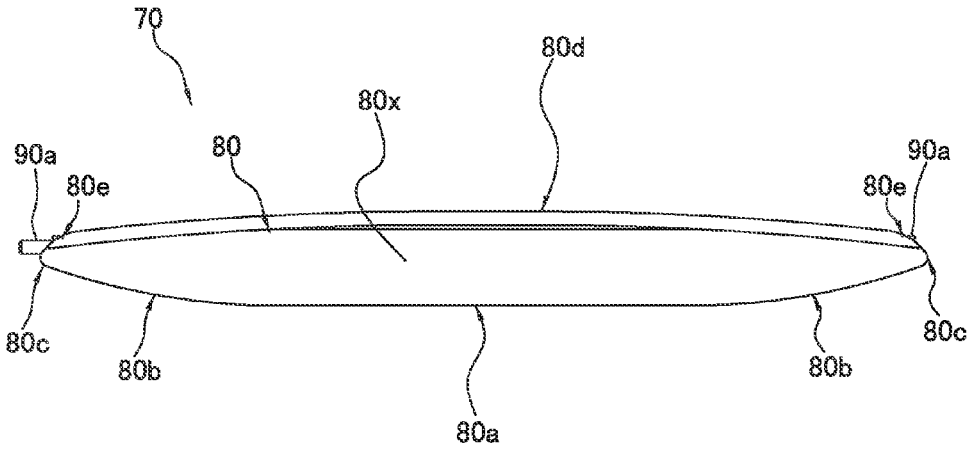
FIG. 9 is an external configuration view, as seen from below, of an outer frame decorative panel.
Figure 10:
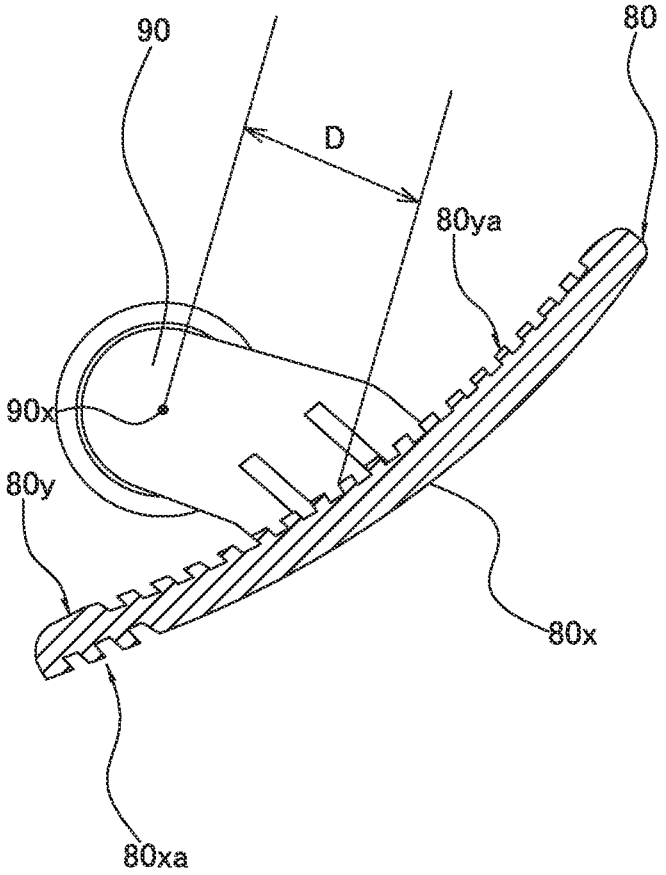
FIG. 10 is an external perspective view of the airflow direction adjusting portion.

As shown in FIG. 10, which is a cross-sectional view as seen in an axial direction, and in FIG. 9, which is an external perspective view regarding a surface mainly facing the room side, the airflow direction adjusting portions 70 have a shape that is long in an axis-of-rotation direction. The airflow direction adjusting portions 70 function as airflow direction adjusting plates that adjust the direction of the conditioned air blown out into the air-conditioned room. In the present embodiment, the airflow direction adjusting portions 70 are not placed in the short-side air outlets 60 of the air outlet 36 and are placed only in the long-side air outlets 50. The airflow direction adjusting portions 70 include a first airflow direction adjusting portion 71 that adjusts the direction of the conditioned air blown out from the first long-side air outlet 51, a second airflow direction adjusting portion 72 that adjusts the direction of the conditioned air blown out from the second long-side air outlet 52, a third airflow direction adjusting portion 73 that adjusts the direction of the conditioned air blown out from the third long-side air outlet 53, and a fourth airflow direction adjusting portion 74 that adjusts the direction of the conditioned air blown out from the fourth long-side air outlet 54.

As shown in FIG. 9, each of the airflow direction adjusting portions 70 has a flap body 80 and an arm 90 that includes a rotating shaft 90*x*.

The flap body 80 is a plate-shaped member formed so as to extend in a direction substantially parallel to the rotating shaft 90*x*, and a front surface 80*x* that is a surface on the opposite side of a back surface 80*y* that is a surface on the side where the arm 90 is attached has a curved shape projecting outward. Because the flap body 80 has a moderately curved shape in this way, the conditioned air passing through the long-side air outlet 50 can be gently guided in the traveling direction. The outer edge of the flap body 80 is formed so as to not have a section with an inwardly recessed shape. As shown in FIG. 10, in a state where the front surface 80*x* is mainly facing the room side (the blow-out airflow downstream side), the flap body 80 is disposed in such a way that the distance between the flap body 80 and the rotating shaft 90*x* becomes shorter as the flap body 80 becomes closer to the room side and is disposed in such a way that the distance between the flap body 80 and the rotating shaft 90*x* becomes longer as the flap body 80 becomes away from the room side (heading toward the blow-out airflow upstream side). Because of this, in a case where the airflow direction adjusting portion 70 has rotated, the airflow direction adjusting portion 70 follows a trajectory that differs between one end and the other end of the flap body 80. As shown in FIG. 10, a concavo-convexly shaped portion 80*xa* is disposed, so as to be along in the lengthwise direction of the flap body 80, on the front surface 80*x* of the flap body 80 in a section in the neighborhood of the outside end portion in a state where the front surface 80*x* is mainly facing the blow-out airflow downstream side. Outside the section where the concavo-convexly shaped portion 80*xa* is disposed, the front surface 80*x* of the flap body 80 is configured by a smooth, substantially flat, surface. Further, a flocked sheet 80*ya* comprising a sheet in which a mixture of short fibers with different pile lengths is uniformly flocked is adhered to the back surface 80*y* of the flap body 80. The flocked sheet 80*ya* is a section that the conditioned air from inside the casing body 31*a* strikes when adjusting the blow-out airflow direction in a state where the front surface 80*x* of the flap body 80 is mainly facing the blow-out airflow downstream side. The flocked sheet 80*ya* can suppress the formation of dew condensation on the flap body 80. As shown in FIG. 10, the flocked sheet 80*ya* is disposed slightly toward the inside in a state where the front surface 80*x* is mainly facing the blow-out airflow downstream side. The flocked sheet 80*ya* is disposed in such a way that there becomes less of a section in which the flocked sheet 80*ya* and the concavo-convexly shaped portion 80*xa* overlap in the plate thickness direction of the flap body 80.

Further, as shown in FIG. 9, which is an external perspective view seen from the front surface 80*x* side, the outer edge shape of the flap body 80 includes a flap inside linear portion 80*a*, flap inside curved portions 80*b*, flap lengthwise direction end portions 80*c*, a flap outside linear portion 80*d*, and flap outside curved portions 80*e*. The flap inside linear portion 80*a* is positioned on the inside of the flap body 80 in a state where the front surface 80*x* of the flap body 80 is facing the room side. The flap inside linear portion 80*a* is the edge of a linearly shaped section extending substantially parallel to the rotating shaft 90*x* direction. The flap inside linear portion 80*a* is disposed in the neighborhood of the center of the flap body 80 in the direction of the rotating shaft 90*x* and occupies a section of about 50% of the flap body 80 in the lengthwise direction. The flap inside curved portions 80*b* are edges that gently connect the flap lengthwise direction end portions 80*c* to both ends of the flap inside linear portion 80*a* and have shapes gently bulging toward the outside of the flap body 80. The flap inside curved portions 80*b* occupy sections of about 25% each from the lengthwise direction end portions of the flap body 80. The flap lengthwise direction end portions 80*c* are placed in positions toward the flap outside linear portion 80*d* in the width direction orthogonal to the rotating shaft 90*x* direction, that is, in a direction orthogonal to both the flap inside linear portion 80*a* and the flap outside linear portion 80*d*. In other words, in a case where the flap body 80 is seen from the front surface 80*x* side, the flap lengthwise direction end portions 80*c* are disposed in such a way that the width direction distance between the flap lengthwise direction end portions 80*c* and the flap inside linear portion 80*a* is longer than the width direction distance between the flap lengthwise direction end portions 80*c* and the flap outside linear portion 80*d*. The flap outside linear portion 80*d* is positioned on the outside of the flap body 80 in a state where the front surface 80*x* of the flap body 80 is facing the room side. The flap outside linear portion 80*d* is the edge of a linearly shaped section extending substantially parallel to the rotating shaft 90*x* direction. The flap outside linear portion 80*d* is also disposed in the neighborhood of the center of flap body 80 in the direction of the rotating shaft 90*x* but is formed shorter than the length of the flap inside linear portion 80*a*. The flap outside curved portions 80*e* are edges that connect, more abruptly than the flap inside curved portions 80*b*, the flap lengthwise direction end portions 80*c* to both ends of the flap outside linear portion 80*d* and have shapes bulging gently outward.

As shown in FIG. 10, the arm 90 extends as far as a section beyond the rotating shaft 90*x* in a direction away from the back surface 80*y* of the flap body 80 in the neighborhoods of both lengthwise direction end portions of the flap body 80. That is, as shown in FIG. 10, the length of the arm 90 is formed longer than a distance D from the back surface 80*y* of the flap body 80 to the rotating shaft 90*x*. The arm 90 extends in such a way that it inclines a little more toward the outer frame decorative panel 38 side than in the plate thickness direction of the flap body 80 in a state where the majority of the front surface 80*x* of the flap body 80 can be seen when the casing body 31*a* is seen from below. As shown in FIG. 9, shaft members 90*a* that extend so as to follow the rotating shafts 90*x* are disposed in the neighborhoods of the end portions of the arms 90 on the opposite sides of the end portions on the flap body 80 side. The arm 90 extends from a little lower side of the back surface 80*y* of the flap body 80 in a state where the front surface 80*x* of the flap body 80 is facing the room side and has a width that is about 30% of the width, in the neighborhood of the center, of the flap body 80.

The placement relationship between the long-side air outlets 50 and the airflow direction adjusting portions 70 will be described later.

The indoor fan 41 is a centrifugal blower placed inside the casing body 31*a*. The indoor fan 41 forms an airflow that sucks the room air through the air inlet 35 in the decorative panel 32 into the casing body 31*a* and blows out the air through the air outlet 36 in the decorative panel 32 to the outside of the casing body 31*a*. The indoor fan 41 has a fan motor 41*a* that is disposed in the center of the top plate 33*a* of the casing body 31*a* and an impeller 41*b* that is coupled to and driven to rotate by the fan motor 41*a*. The impeller 41*b* is an impeller having turbo blades and can suck air into the inside of the impeller 41*b* from below and blow out the air toward the outer peripheral side of the impeller 41*b* as seen from above.

The indoor heat exchanger 42 is a fin-and-tube heat exchanger that is bent so as to surround the periphery of the indoor fan 41 as seen from above and is placed inside the casing body 31*a*. More specifically, the indoor heat exchanger 42 is a fin-and-tube heat exchanger called a cross-fin type that has numerous heat transfer fins placed a predetermined interval apart from each other and plural heat transfer tubes disposed in a state where they penetrate these heat transfer fins in their plate thickness direction. As described above, the liquid side of the indoor heat exchanger 42 is connected to the liquid refrigerant connection tube 5 via the liquid-side connecting tube 5*a*. The gas side of the indoor heat exchanger 42 is connected to the gas refrigerant connection tube 6 via the gas-side connecting tube 6*a*. Additionally, the indoor heat exchanger 42 functions as an evaporator of the refrigerant during cooling and as a condenser of the refrigerant during heating. Because of this, the indoor heat exchanger 42 can perform heat exchange with the air that has been blown out from the indoor fan 41, cool the air during cooling, and heat the air during heating.

The drain pan 40 is placed on the underside of the indoor heat exchanger 42 and receives drain water produced as a result of moisture in the air condensing in the indoor heat exchanger 42. The drain pan 40 is attached to the lower portion of the casing body 31*a*. Outlet holes 40*a*, an inlet hole 40*b*, and a drain water receiving channel 40*c* are formed in the drain pan 40. The outlet holes 40*a* are formed in various places so as to be communicated with the air outlet 36 in the decorative panel 32. The inlet hole 40*b* is formed so as to be communicated with the air inlet 35 in the decorative panel 32. The drain water receiving channel 40*c* is formed on the underside of the indoor heat exchanger 42.

The bell mouth 41*c* is placed so as to correspond to the inside of the inlet hole 40*b* in the drain pan 40 and guides the air sucked in from the air inlet 35 to the impeller 41*b* of the indoor fan.

<1-3> Control Unit 7

As shown in FIG. 1, a control unit 7 has an outdoor control unit 7*a* that controls the various configural devices of the outdoor unit 2, an indoor control unit 7*b* that controls the various configural devices of the indoor unit 4, and a controller 7*c* for receiving setting inputs from a user.

The control unit 7 performs: independent airflow direction control that independently adjusts the airflow directions of the conditioned air blown out from four air outlets—the first long-side air outlet 51, the second long-side air outlet 52, the third long-side air outlet 53, and the fourth long-side air outlet 54—of the air outlet 36 by performing control that allows the first airflow direction adjusting portion 71, the second airflow direction adjusting portion 72, the third airflow direction adjusting portion 73, and the fourth airflow direction adjusting portion 74 to be moved independently, per each airflow direction adjusting portion 70, to thereby change their rotational states; and interlocking airflow direction control that interlockingly adjusts the aforementioned airflow direction by performing control that causes all of the first airflow direction adjusting portion 71, the second airflow direction adjusting portion 72, the third airflow direction adjusting portion 73, and the fourth airflow direction adjusting portion 74 to move interlockingly so that their postures have the same rotational state. Here, the controller 7*c* has an input button and other components and receives from the user an instruction to either perform the independent airflow direction control or perform the interlocking airflow direction control. Additionally, the control unit 7 performs the independent airflow direction control or the interlocking airflow direction control in accordance with the instruction to perform the independent airflow direction control or the interlocking airflow direction control that the controller 7*c* has received.

In addition to the independent airflow direction control and the interlocking airflow direction control, the control unit 7 also performs, in regard to the four air outlets—the first long-side air outlet 51, the second long-side air outlet 52, the third long-side air outlet 53, and the fourth long-side air outlet 54—of the air outlet 36, individual air volume suppression control that most reduces the volume of air blown out from a specific long-side air outlet 51 to 54 by individually independently adjusting the rotational state of each of the airflow direction adjusting portions 70 including the first airflow direction adjusting portion 71, the second airflow direction adjusting portion 72, the third airflow direction adjusting portion 73, and the fourth airflow direction adjusting portion 74 to change the posture. Here, the controller 7*c* can, like described above, receive from the user an instruction to perform the individual air volume suppression control and a designation of a specific long-side air outlet 50 of the long-side air outlets 50 selected to have the volume of air blown out from that, long-side air outlet suppressed. Additionally, in a case where the controller 7*c* has received an instruction to perform the individual air volume suppression control, the control unit 7 performs the individual air volume suppression control by rotating the airflow direction adjusting portion 70 placed in the position of the specific long-side air outlet 50 in such a way that the volume of air blown out from the specific long-side air outlet 50 becomes most reduced. Here, the number of the long-side air outlets 50 whose air volumes can be suppressed by the individual air volume suppression control at the same time is two or less, and the control unit 7 prohibits the individual air volume suppression control from being performed at the same time in regard to three or more of the long-side air outlets 50. Specifically, the control unit 7 allows the individual air volume suppression control to be continued in regard to specific long-side air outlets 50 whose designation the control unit 7 has received first and second, and the control unit 7 ignores setting inputs of the individual air volume suppression control in regard to specific long-side air outlets 50 whose designation the controller 7*c* receives thereafter. In a case where the user cancels, from the controller 7*c*, the individual air volume suppression control in regard to a specific long-side air outlet 50, the control unit 7 can then perform the individual air volume suppression control in regard to another long-side air outlet 50.

<Basic Actions>

Next, the actions of the air conditioning apparatus 1 during a cooling operation and a heating operation will be described.

<2-1> Cooling Action

In the refrigerant circuit 10 during cooling, the four-way switching valve 22 is in the state indicated by the solid lines in FIG. 1. Further, the liquid-side stop valve 25 and the gas-side stop valve 26 are placed in an open state, and the opening degree of the expansion valve 24 is adjusted so as to reduce the pressure of the refrigerant.

In this state of the refrigerant circuit 10, low-pressure gas refrigerant is sucked into the compressor 21. In the compressor 21, the low-pressure gas refrigerant is compressed and becomes high-pressure gas refrigerant. The high-pressure gas refrigerant is discharged from the compressor 21. The high-pressure gas refrigerant is sent through the four-way switching valve 22 to the outdoor heat exchanger 23. In the outdoor heat exchanger 23, the high-pressure gas refrigerant performs heat exchange with the outdoor air, condenses, and becomes high-pressure liquid refrigerant. The high-pressure liquid refrigerant is sent to the expansion valve 24. In the expansion valve 24, the high-pressure liquid refrigerant has its pressure reduced and becomes low-pressure refrigerant in a gas-liquid two-phase state. The low-pressure refrigerant in the gas-liquid two-phase state is sent through the liquid-side stop valve 25, the liquid refrigerant connection tube 5, and the liquid-side connecting tube 5*a* to the indoor heat exchanger 42. In the indoor heat exchanger 42, the low-pressure refrigerant in the gas-liquid two-phase state performs heat exchange with the air blown out from the indoor fan 41, evaporates, and becomes low-pressure gas refrigerant. The low-pressure gas refrigerant is sent back to the compressor 21 through the gas-side connecting tube 6*a*, the gas refrigerant connection tube 6, the gas-side stop valve 26, and the four-way switching valve 22.

<2-2> Heating Action

Next, in the refrigerant circuit 10 during heating, the four-way switching valve 22 is in the state indicated by the broken lines in FIG. 1. Further, the liquid-side stop valve 25 and the gas-side stop valve 26 are placed in an open state, and the opening degree of the expansion valve 24 is adjusted in such a way that the expansion valve 24 reduces the pressure of the refrigerant.

In this state of the refrigerant circuit 10, low-pressure gas refrigerant is sucked into the compressor 21. In the compressor 21, the low-pressure gas refrigerant is compressed and becomes high-pressure gas refrigerant. The high-pressure gas refrigerant is discharged from the compressor 21. The high-pressure gas refrigerant is sent to the indoor heat exchanger 42 through the four-way switching valve 22, the gas-side stop valve 26, the gas refrigerant connection tube 6, and the gas-side connecting tube 6*a*. In the indoor heat exchanger 42, the high-pressure gas refrigerant performs heat exchange with the air blown out from the indoor fan 41, condenses, and becomes high-pressure liquid refrigerant. The high-pressure liquid refrigerant is sent through the liquid-side connecting tube 5*a*, the liquid refrigerant connection tube 5, and the liquid-side stop valve 25 to the expansion valve 24. In the expansion valve 24, the high-pressure liquid refrigerant has its pressure reduced and becomes low-pressure refrigerant in a gas-liquid two-phase state. The low-pressure refrigerant in the gas-liquid two-phase state is sent to the outdoor heat exchanger 23. In the outdoor heat exchanger 23, the low-pressure refrigerant in the gas-liquid two-phase state performs heat exchange with the outdoor air, evaporates, and becomes low-pressure gas refrigerant. The low-pressure gas refrigerant is sent through the four-way switching valve 22 back to the compressor 21.

<3> Placement Relationship Between Long-side Air Outlets 50 and Airflow Direction Adjusting Portions 70

Here, the placement of the first airflow direction adjusting portion 71 in the neighborhood of the first long-side air outlet 51 will be described. The neighborhood of the second long-side air outlet 52, the neighborhood of the third long-side air outlet 53, and the neighborhood of the fourth long-side air outlet 54 are the same as the neighborhood of the first long-side air outlet 51, so description thereof will be omitted.

<3-1> Placement Relationship as Seen from Below

Figure 11:
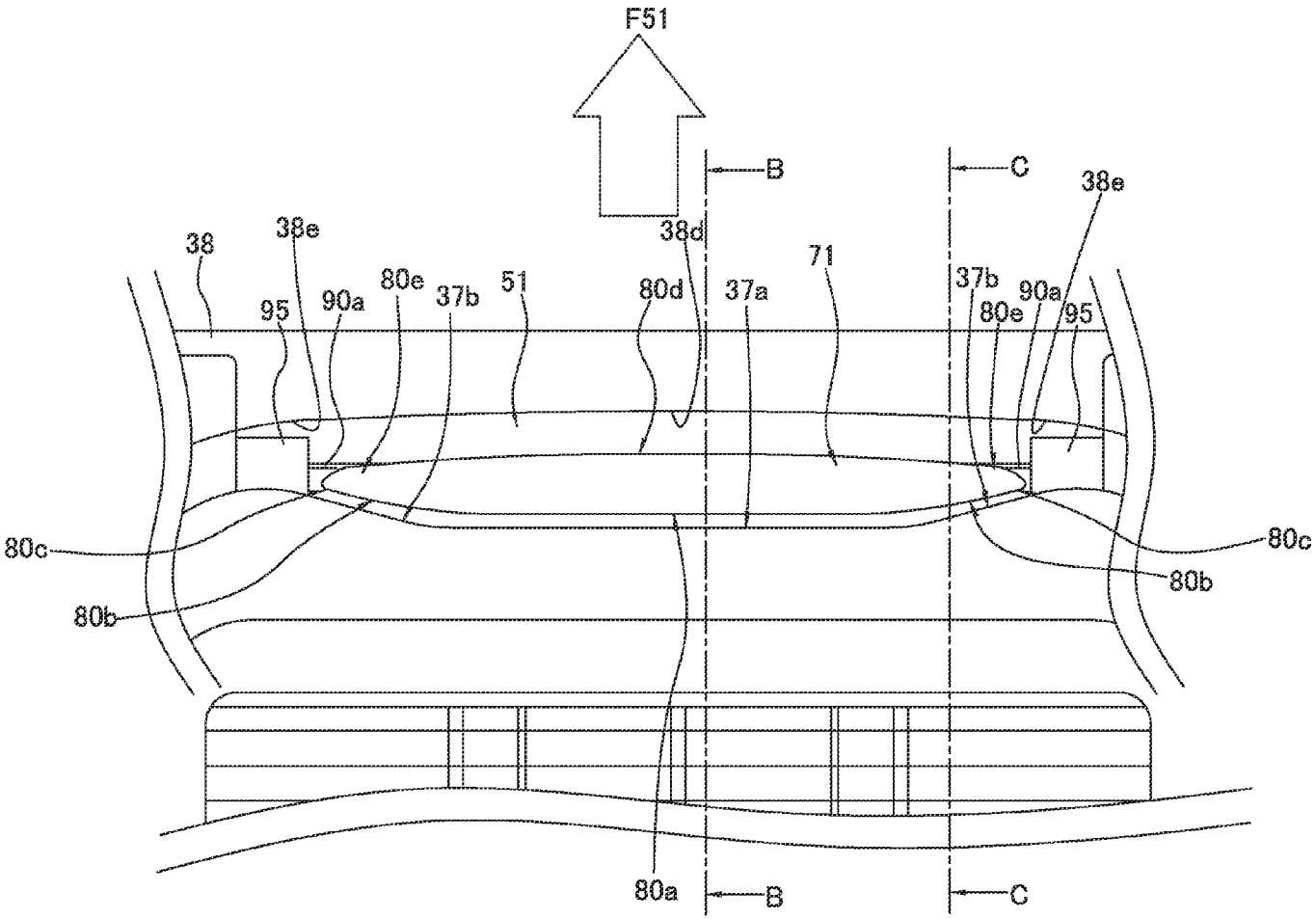
FIG. 11 is a partially enlarged external view, as seen from below, of the neighborhood of a first long-side air outlet.

FIG. 11 is a partially enlarged external view, as seen from below, of the neighborhood of the first long-side air outlet 51.

When the indoor unit 4 is seen from below, the first airflow direction adjusting portion 71 and airflow direction adjusting drive units 95 are placed on the inside of the first long-side air outlet 51.

The airflow direction adjusting drive units 95 are disposed on the insides of both lengthwise direction ends of the first long-side air outlet 51 and on the outsides of both lengthwise direction ends of the first airflow direction adjusting portion 71. The airflow direction adjusting drive units 95 are connected to the first airflow direction adjusting portion 71 via the shaft members 90*a* extending so as to follow the rotating shafts 90*x* from the arms 90 of the first airflow direction adjusting portion 71 and apply a driving force for causing the first airflow direction adjusting portion 71 to rotate. Specifically, the airflow direction adjusting drive units 95 and the shaft members 90*a* of the first airflow direction adjusting portion 71 configure unillustrated cam mechanisms, and drive control via the cam mechanisms is performed as a result of the control unit 7 sending to the airflow direction adjusting drive units 95 a control signal for causing the airflow direction adjusting drive units 95 to control the drive state of the first airflow direction adjusting portion 71.

The outside edge of the first long-side air outlet 51 is configured by the outer frame decorative panel 38, the inside edge of the first long-side air outlet 51 is configured by the inner frame decorative panel 37, and the lengthwise direction end portions of the first long-side air outlet 51 are configured by the inside side surfaces of the airflow direction adjusting drive units 95. The width, at the lengthwise direction end portions (the inside side surfaces of the airflow direction adjusting drive units 95), of the first long-side air outlet 51 is formed so as to be about 60% of the width, in the neighborhood of the lengthwise direction center, of the first long-side air outlet 51. Specifically, the outside edge of the first long-side air outlet 51 is configured by the outer frame air outlet-side linear portion 38*d* and the outer frame air outlet-side curved portions 38*e* of the outer frame decorative panel 38. Further, the inside edge of the first long-side air outlet 51 is configured by the inner frame air outlet-side linear portion 37*a* and the inner frame air outlet-side curved portions 37*b* of the inner frame decorative panel 37. Because of this, the first long-side air outlet 51 has, when seen from below, a shape that bulges greatly inward while bulging a little outward. The bulging of the first long-side air outlet 51 inward is formed so as to be greater than the bulging of the first long-side air outlet 51 outward.

The outer frame air outlet-side linear portion 38*d* of the outer frame decorative panel 38 is positioned in the neighborhood of the lengthwise direction center of the first long-side air outlet 51. The outer frame air outlet-side curved portions 38*e* of the outer frame decorative panel 38 are positioned in the neighborhoods of both lengthwise direction ends of the first long-side air outlet 51 and in the neighborhoods of the outsides of the airflow direction adjusting drive units 95.

The inner frame air outlet-side linear portion 37*a* of the inner frame decorative panel 37 is positioned in the neighborhood of the lengthwise direction center of the first long-side air outlet 51. The inner frame air outlet-side curved portions 37*b* of the inner frame decorative panel 37 are positioned a little inside of both lengthwise direction ends of the first long-side air outlet 51 and on the insides of the airflow direction adjusting drive units 95 and in the neighborhoods between the airflow direction adjusting drive units 95 and the first airflow direction adjusting portion 71.

The horizontal direction width between the flap outside linear portion 80*d* and the flap outside curved portions 80*e* configuring the outside edge of the flap body 80 of the first airflow direction adjusting portion 71 and the outer frame air outlet-side linear portion 38*d* and the outer frame air outlet-side curved portions 38*e* of the outer frame decorative panel 38 configuring the outside edge of the first long-side air outlet 51 is placed so as to be substantially the same width (about 2 cm) across in the entire lengthwise direction of the first long-side air outlet 51.

The horizontal direction width between of the flap inside linear portion 80*a*, the flap inside curved portions 80*b*, and the flap lengthwise direction end portions 80*c* configuring the inside edge of the flap body 80 of the first airflow direction adjusting portion 71 and the inner frame air outlet-side linear portion 37*a* and the inner frame air outlet-side curved portions 37*b* of the outer frame decorative panel 38 configuring the inside edge of the first long-side air outlet 51 is placed so as to be substantially the same width (about 1 cm) across in the entire lengthwise direction of the first long-side air outlet 51 so that the mutual edges follow each other.

The width between the inside edge of the flap body 80 of the first airflow direction adjusting portion 71 and the inside edge of the first long-side air outlet 51 is configured to be equal to or less than half of the width between the outside edge of the flap body 80 of the first airflow direction adjusting portion 71 and the outside edge of the first long-side air outlet 51.

<3-2> Placement Relationship in Neighborhood of Center of Airflow Direction Adjusting Portions 70

Figure 12:
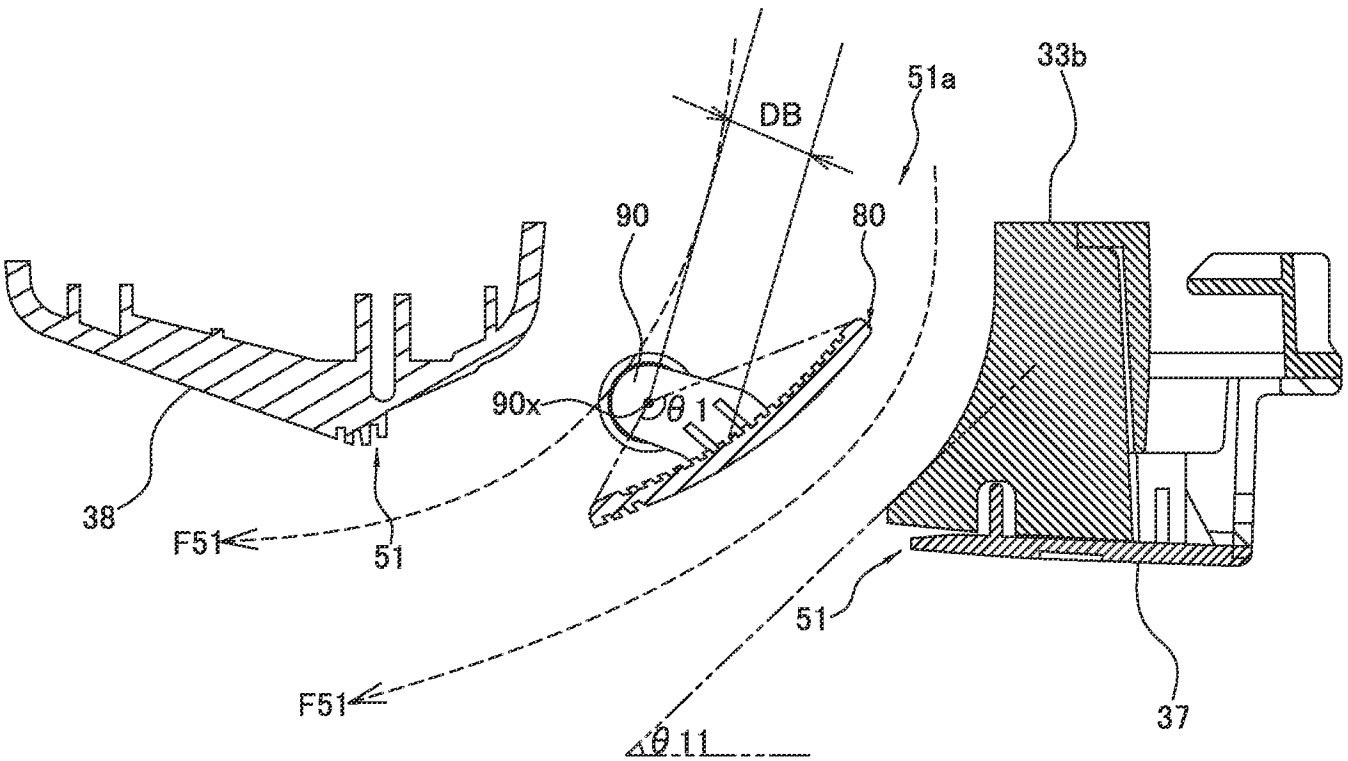
FIG. 12 is a schematic cross-sectional view showing, in the neighborhood of the first long-side air outlet in cross section B-B in FIG. 11, an example of a postural state of the airflow direction adjusting portion during independent airflow direction control or interlocking airflow direction control.

FIG. 12 is a schematic cross-sectional view, in cross section B-B in FIG. 11, in the neighborhood of the first long-side air outlet 51. The posture of the airflow direction adjusting portion 70 shown in FIG. 12 is an example of the posture of the flap body 80 in a case where the independent airflow direction control or the interlocking airflow direction control is being performed.

As shown in FIG. 12, the first long-side air outlet flow path 51*a* extends toward the airflow upstream side from the first long-side air outlet 51. The inside wall surface of the first long-side air outlet flow path 51*a* in the neighborhood of the first long-side air outlet 51 is configured by the bottom plate 33*b* of the casing body 31*a*. In the neighborhood of the lengthwise direction center of the flap body 80, the inside wall surface of the first long-side air outlet flow path 51*a* has, as shown in FIG. 12, a shape curved in such a way that the center of its radius of curvature is positioned on the rotating shaft 90*x* side, and the inside wall surface of the first long-side air outlet flow path 51*a* is formed so as to be positioned further outside closer to the first long-side air outlet 51. In the neighborhood of the lengthwise direction center of the flap body 80, the outside wall surface of the first long-side air outlet flow path 51*a* has, as shown in FIG. 12, a shape curved in such a way that the center of its radius of curvature is positioned on the opposite side of the rotating shaft 90*x* side so that the distance between the outside wall surface and the inside wall surface is maintained, and the outside wall surface of the first long-side air outlet flow path 51*a* is formed so as to be positioned further outside closer to the first long-side air outlet 51. The neighborhood of the center of the first long-side air outlet flow path 51*a* is inclined in such a way that an angle of inclination θ11 of the inside wall surface and the outside wall surface in the section of the first long-side air outlet 51 in the blow-out direction end portion is about 40° with respect to the horizontal direction, so that the blown-out air can be guided more outward.

The rotating shaft 90*x* is positioned on the airflow direction upstream side of the first long-side air outlet 51 positioned in the end portion of the first long-side air outlet flow path 51*a*. Further, the rotating shaft 90*x* is placed so as to be closer to the outside wall surface side of the first long-side air outlet flow path 51*a* than the inside wall surface side of the first long-side air outlet flow path 51*a*.

The arm 90 is positioned in a position substantially coinciding with, or on the airflow upstream side of, the first long-side air outlet 51 positioned in the end portion of the first long-side air outlet flow path 51*a* even in the rotational state closest to the first long-side air outlet 51 of the rotational states of the first airflow direction adjusting portion 71.

As shown in FIG. 12, the width direction length, in the neighborhood of the center, of the flap body 80 is disposed in such a way that an angle θ1 formed by a line joining together the rotating shaft 90*x* and one width direction end side of the flap body 80 and a line joining together the rotating shaft 90*x* and the width direction other end side of the flap body 80 is about 135°.

When the independent airflow direction control or the interlocking airflow direction control is being performed, the flap body 80 of the airflow direction adjusting portion 70 is swung by the airflow direction adjusting drive units 95 in the range of about +30° and about −30° taking as a reference a state where the angle of inclination of the section, in the neighborhood of the center, of the front surface 80*x* is about 30° (corresponding to FIG. 12).

<3-3> Placement Relationship in Neighborhoods of End Portions of Airflow Direction Adjusting Portions 70

Figure 13:
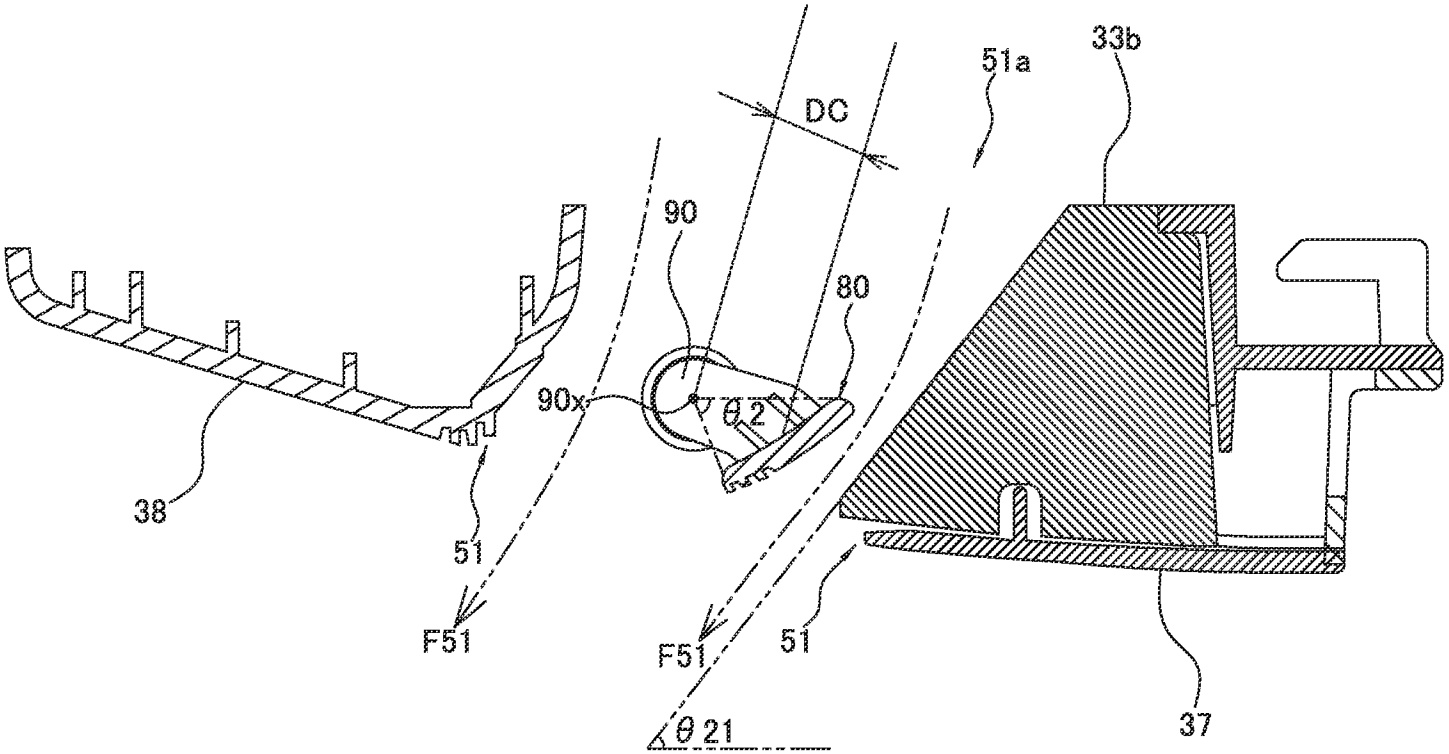
FIG. 13 is a schematic cross-sectional view showing, in the neighborhood of the first long-side air outlet in cross section C-C in FIG. 11, an example of a postural state of the airflow direction adjusting portion during the independent airflow direction control or the interlocking airflow direction control.

FIG. 13 is a schematic cross-sectional view, in cross section C-C in FIG. 11, in the neighborhood of the first long-side air outlet 51.

In the neighborhoods of the lengthwise direction end portions of the flap body 80, the inside wall surface of the first long-side air outlet flow path 51*a* has, as shown in FIG. 13, a planar shape formed so as to be positioned further outside closer to the first long-side air outlet 51, so that the shape differs from the curved shape in the neighborhood of the center. Further, in the neighborhoods of the lengthwise direction end portions of the flap body 80, the outside wall surface of the first long-side air outlet flow path 51*a* is like the inside wall surface and has, as shown in FIG. 13, a planar shape formed so as to be positioned further outside closer to the first long-side air outlet 51, so that the shape differs from the curved shape in the neighborhood of the center. The shapes of the inside wall surface and the outside wall surface of the first long-side air outlet flow path 51*a* are formed in such a way that the shape in the neighborhood of the lengthwise direction center of the flap body 80 and the shape in the neighborhoods of the lengthwise direction end portions of the flap body 80 change gradually in accordance with the lengthwise direction position of the flap body 80. The neighborhood of the end portion of the first long-side air outlet flow path 51*a* is inclined in such a way that an angle of inclination θ21 of the inside wall surface and the outside wall surface in the section of the first long-side air outlet 51 in the blow-out direction end portion is about 55° with respect to the horizontal direction, so that the blown-out air can be guided more downward.

The width direction length, in the neighborhoods of the end portions, of the flap body 80 is disposed in such a way that, as shown in FIG. 13, an angle θ2 formed by a line joining together the rotating shaft 90*x* and one width direction end side of the flap body 80 and a line joining together the rotating shaft 90*x* and the other width direction end side of the flap body 80 is about 75°. In other words, the width direction length, in the neighborhoods of the end portions, of the flap body 80 is configured so as to be about 40% of the width direction length, in the neighborhood of the center, of the flap body 80.

<4> Placement Relationship Between Long-side Air Outlets 50 and Airflow Direction Adjusting Portions 70 During Shutdown When the controller 7*c* receives from the user an instruction to shut down (a state where the cooling action and the heating action are not performed), the control unit 7 sends a control signal to the airflow direction adjusting drive units 95 to cause all of the airflow direction adjusting portions 70—that is, all of the first airflow direction adjusting portion 71, the second airflow direction adjusting portion 72, the third airflow direction adjusting portion 73, and the fourth airflow direction adjusting portion 74—to rotate, whereby the airflow direction adjusting portions 70 are adjusted so that the centers of their front surfaces 80*x* face substantially vertically downward.

Because of this, during shutdown, when the indoor unit 4 is seen from below, the insides of the long-side air outlets 50 appear most covered by the airflow direction adjusting portions 70, so that the sense of unity between the decorative panel 32 and the airflow direction adjusting portions 70 can be improved. Because of this, the design of the indoor unit 4 during shutdown can be improved, and the user can easily know that the indoor unit 4 is in a shutdown state.

Figure 14:
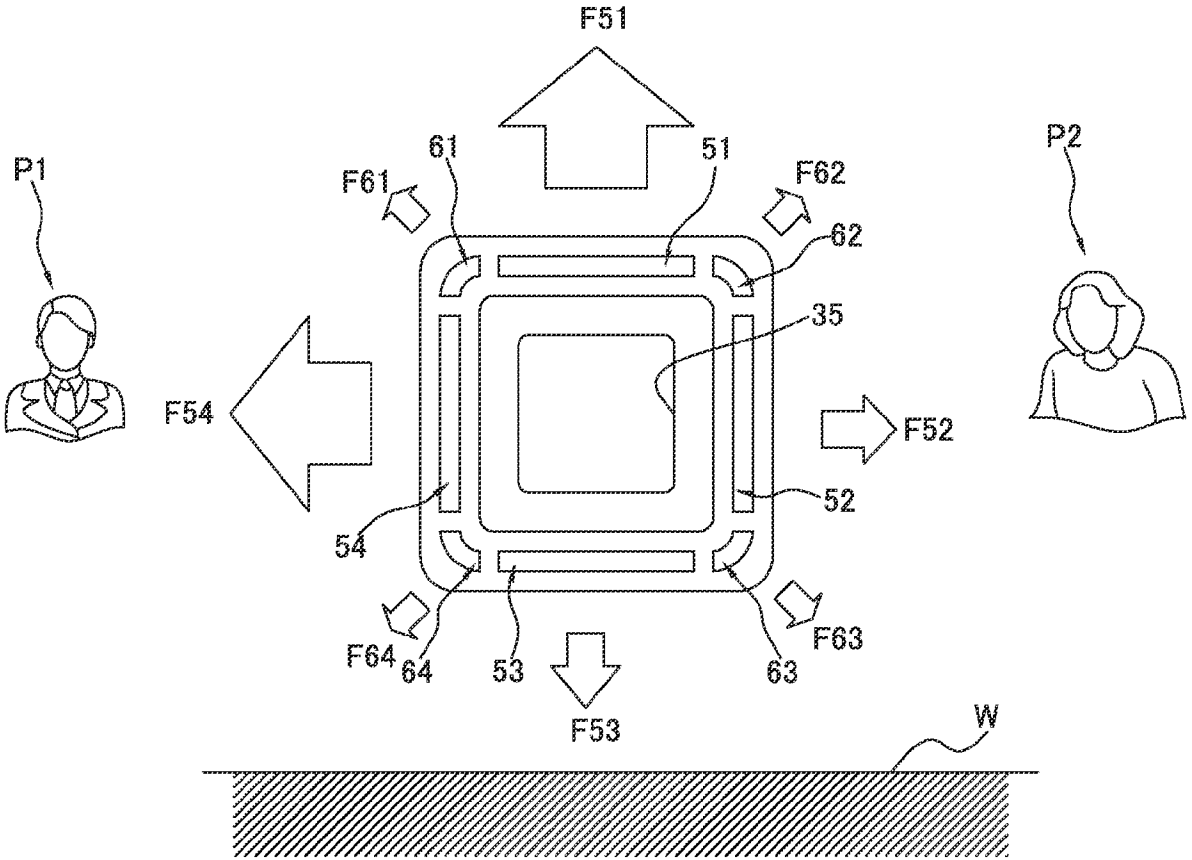
FIG. 14 is a conceptual diagram of air volume suppression control.

<5> Placement Relationship Between Long-side Air Outlets 50 and Airflow Direction Adjusting Portions 70 During Individual Air Volume Suppression Control FIG. 14 is a conceptual diagram of the air volume suppression control.

When the controller 7*c* receives from the user an instruction to suppress the volume of air blown out from a specific long-side air outlet 50, the control unit 7 sends a control signal to the airflow direction adjusting drive units 95, of the airflow direction adjusting drive units 95, that control the rotational state of the airflow direction adjusting portion 70 disposed in the position corresponding to the specific long-side air outlet 50 instructed by the user. Because of this, the airflow direction adjusting drive units 95 that have received the control signal cause the airflow direction adjusting portion 70 whose rotational state they themselves control to rotate, to thereby adjust the airflow direction adjusting portion 70 to a posture that restricts the volume of air blown out from the long-side air outlet 50 specified by the user. For example, as shown in FIG. 14, in a case where the indoor unit 4 is placed near a wall surface W in a room and near a user P1 and a user P2, when the controller 7*c* receives an instruction to suppress the volume of air blown out toward the user P2, the control unit 7 performs the individual air volume suppression control to reduce the volume of the airflow F53 blown out from the third long-side air outlet 53 toward the wall surface W and to also reduce the volume of the airflow F52 blown out from the second long-side air outlet 52 toward the user P2. Because of this, useless provision of conditioned air toward the wall surface W where there is no user can be reduced, and the air volume desired by the user P2 can be realized. For example, the instruction given by the user P2 may include a case where the user P2 wants to reduce the sensation of a draft or a case where the user P2 feels too cool or too warm due to cooling or heating.

Figure 15:
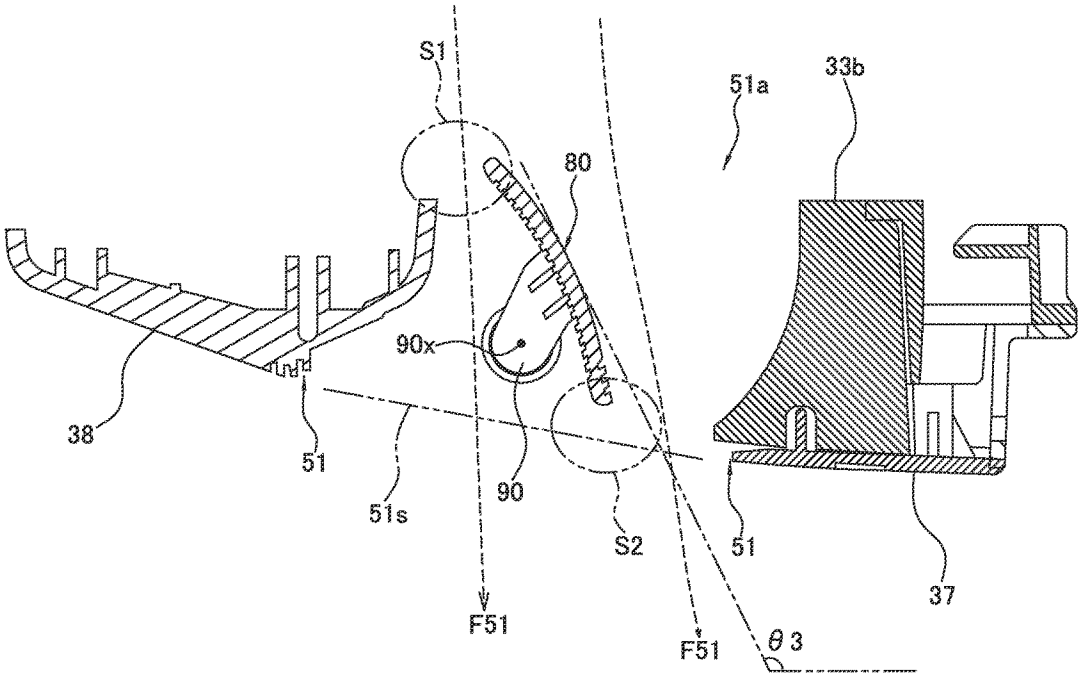
FIG. 15 is a schematic cross-sectional view showing, in the neighborhood of the first long-side air outlet in cross section B-B in FIG. 11, an example of a postural state of the airflow direction adjusting portion during the air volume suppression control.

FIG. 15 is a cross-sectional view, corresponding to cross section B-B in FIG. 11, showing an example of the inclined state of the airflow direction adjusting portion 70 during the individual air volume suppression control.

The flap body 80 on which the individual air volume suppression control is performed is adjusted by the airflow direction adjusting drive units 95 in such a way that the front surface 80*x* faces the airflow upstream side of the first long-side air outlet flow path 51*a*. Specifically, the flap body 80 is adjusted by the airflow direction adjusting drive units 95 in such a way that an angle of inclination θ3 (an inside angle) of the section, in the neighborhood of the center, of the front surface 80*x* with respect to a horizontal plane is about 110° (which corresponds to FIG. 15). During the individual air volume suppression control, as for the posture of the flap body 80, the flap body 80 is rotated by the airflow direction adjusting drive units 95, but the flap body 80 and the wall surfaces of the first long-side air outlet flow path 51*a* have a placement relationship such that they do not contact each other during the action of the rotation of the flap body 80 from the posture shown in FIG. 12 where the independent airflow direction control or the interlocking airflow direction control is being performed to the posture shown in FIG. 15 where the individual air volume suppression control is being performed. Both the width direction one end side and the width direction other end side of the flap body 80 are temporarily positioned on the airflow downstream side of a surface 51*s* of the first long-side air outlet 51 shown in FIG. 15 in a case where the flap body 80 is being swung by the airflow direction adjusting drive units 95 during the independent airflow direction control or the interlocking airflow direction control.

Because of this, the volume of air blown out from the long-side air outlet 50 on which the individual air volume suppression control has been performed can be reduced. The angle of inclination during the individual air volume suppression control is finely adjusted in the range of +5° and −5° from the angle of about 110°.

In a state where the individual air volume suppression control has been performed, a gap of about 5 mm to 10 mm is ensured (in the section indicated by S1 in FIG. 15) between the wall surface of the first long-side air outlet flow path 51*a* on the outer frame decorative panel 38 side and the end portion on the upper side of the flap body 80, so that a little blow-out air flows through there.

Further, in a state where the individual air volume suppression control has been performed, the end portion on the lower side of the flap body 80 (the section indicated by S2 in FIG. 15) is positioned more on the airflow upstream side in the first long-side air outlet flow path 51*a* than the first long-side air outlet 51. Because of this, substantially the entire periphery of the flap body 80 can be enveloped by the conditioned air whose temperature has been adjusted inside the indoor unit 4, and it can be made difficult for the air in the room whose temperature has not been adjusted to touch the flap body 80. For this reason, even in a state where the volume of air blown out from the long-side air outlet 50 has been reduced by the individual air volume suppression control, it can be made difficult for the room air whose temperature has not been adjusted to reach the flap body 80, and the formation of dew condensation on the flap body 80 can be suppressed.

<6> Characteristics of Present Embodiment (1)

In the indoor unit 4 of the air conditioning apparatus 1 of the present embodiment, the flap body 80 positioned in the long-side air outlet 50 specified during the individual air volume suppression control can significantly suppress the volume of air blown out from the specific long-side air outlet 50 as a result of the rotational state of the airflow direction adjusting portion 70 being adjusted by the airflow direction adjusting drive units 95. Because of this, the volume of air blown out in a specific direction can be suppressed without blocking the specific long-side air outlet 50 using a member separate from the flap body 80 etc. or greatly changing the airflow direction.

Moreover, the control unit 7 automatically starts the individual air volume suppression control simply as a result of the user designating and inputting to the controller 7*c* a specific long-side air outlet 50 of the plural long-side air outlets 51 to 54, so the comfort of a specific user can be improved with a simple action.

(2)

Figure 16:
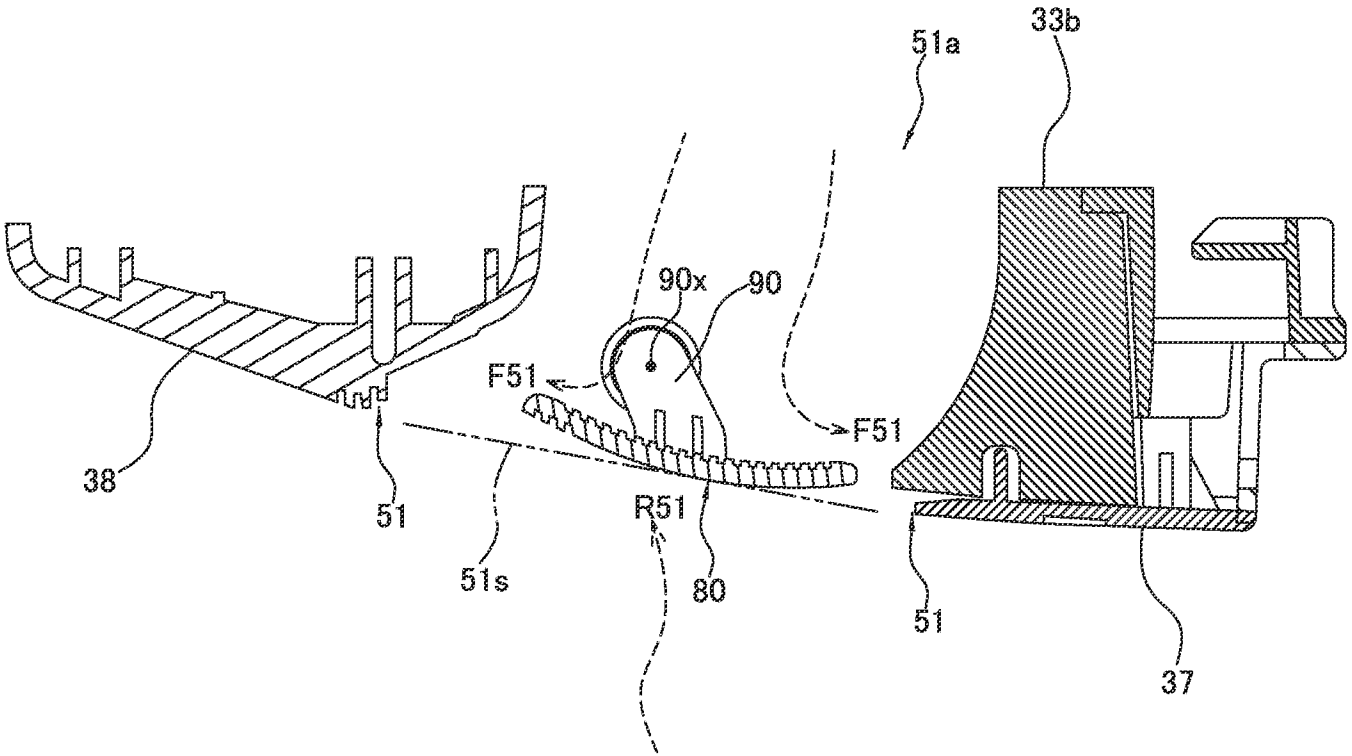
FIG. 16 is a schematic cross-sectional view showing, in the neighborhood of the first long-side air outlet in cross section B-B in FIG. 11, a comparative example of a postural state of the airflow direction adjusting portion.

For example, when blocking the first long-side air outlet 51 in the individual air volume suppression control, in contrast to the above embodiment, as shown in the comparative example of FIG. 16, when employing a rotational state to the extent that the surface of the flap body 80 in the neighborhood of the lengthwise direction center of the front surface 80*x* becomes parallel to the surface 51*s* of the first long-side air outlet 51, it is difficult for the air whose temperature has been adjusted from the inside of the indoor unit 4 to touch the front surface 80*x* side of the flap body 80, and it is easy for air R51 whose temperature has not been adjusted on the room side to flow into the front surface 80*x* side of the flap body 80. On the other hand, it is easy for the air whose temperature has been adjusted from the inside of the indoor unit 4 to touch the back surface 80*y* side of the flap body 80. For this reason, even if it can be made to appear that the first long-side air outlet 51 is closed, it is easy for a temperature difference to arise between the front surface 80*x* and the back surface 80*y* of the flap body 80, and it is easy for dew condensation to form on the front surface of the flap body 80.

With respect to this, in the indoor unit 4 of the air conditioning apparatus 1 of the present embodiment, as shown in FIG. 15, while the airflow direction adjusting drive units 95 adjust the posture of the flap body 80 in such a way the front surface 80*x* of the flap body 80 during the individual air volume suppression control faces the upstream side of the first long-side air outlet flow path 51*a* etc., the flap body 80 is adjusted by the airflow direction adjusting drive units 95 in such a way that the outside wall surface of the first long-side air outlet flow path 51*a* and the one end of the flap body 80 have a positional relationship in which they do not contact each other (see S1 in FIG. 15). For this reason, air whose temperature has been adjusted flows on both the front surface 80*x* side and the back surface 80*y* side of the flap body 80.

Further, by putting the rotational state of the flap body 80 during the individual air volume suppression control into a state with the angle of inclination shown in FIG. 15, the airflow heading from the first long-side air outlet 51 outside can be effectively suppressed, and differences in the percentages of the volumes of the conditioned air flowing on the front surface 80*x* side and the back surface 80*y* side can be more or less suppressed.

Moreover, the rotational state of the flap body 80 during the individual air volume suppression control is adjusted in such a way that, as shown in FIG. 15, the projecting front surface 80*x* side of the flap body 80 faces the upstream side of the first long-side air outlet flow path 51*a* and the recessed back surface 80*y* side of the flap body 80 faces the downstream side of the first long-side air outlet flow path 51*a*. For this reason, compared to a posture where, as shown in FIG. 16, the projecting front surface 80*x* side of the flap body 80 faces the downstream side of the first long-side air outlet flow path 51*a* and the recessed back surface 80*y* side of the flap body 80 faces the upstream side of the first long-side air outlet flow path 51*a*, it becomes more difficult for a temperature difference between the front surface 80*x* side and the back surface 80*y* side of the flap body 80 to arise. Further, the extent of turbulence in the traveling direction of the conditioned air can be suppressed.

In addition, the airflow direction adjusting drive units 95 adjust the rotational state of the airflow direction adjusting portion 70 in such a way that the flap body 80 during the individual air volume suppression control does not have a section positioned on the airflow direction downstream side of the long-side air outlet 50. Because of this, it becomes more difficult for the air whose temperature has not been adjusted on the room side to reach the flap body 80.

Additionally, the flap body 80 during the individual air volume suppression control has a posture where the air whose temperature has been adjusted more easily strikes the front surface 80*x* side than the back surface 80*y* side, but because the flocked sheet 80*ya* that suppresses the formation of dew condensation is disposed on the back surface 80*y* side of the flap body 80, it is difficult for dew condensation to form even if the room air whose temperature has not been adjusted were to more or less flow into the back surface 80*y* side of the flap body 80.

Because of this, the air whose temperature has been adjusted can flow along not only the front surface 80*x* but also the back surface 80*y* with respect to the flap body 80 when performing the individual air volume suppression control. For this reason, the temperature difference between the front surface 80*x* and the back surface 80*y* of the flap body 80 can be kept small, and the formation of dew condensation can be more effectively suppressed. Particularly in a state where the air conditioning apparatus 1 is performing the cooling action, the formation of dew condensation on the flap body 80 can be suppressed.

(3)

In the indoor unit 4 of the air conditioning apparatus 1 of the present embodiment, as described above, a structure by which the position of the flap body 80 in the airflow direction in the first long-side air outlet flow path 51*a* is caused to move so as to be on the downstream side during the independent airflow direction control or the interlocking airflow direction control and on the upstream side during the individual air volume suppression control is realized as a result of the arms 90 interconnecting the rotating shafts 90*x* and the flap body 80 placed in a position away from the rotating shafts 90*x*.

In this way, by employing a structure where the flap body 80 is placed away from the rotating shafts 90*x* and where the rotating shafts 90*x* and the flap body 80 are interconnected by the arms 90, the flap body 80 can be easily moved to a desired position during each control simply by rotating.

(4)

In the indoor unit 4 of the air conditioning apparatus 1 of the present embodiment, in the long-side air outlet 50 on which the individual air volume suppression control is being performed, the air tends to flow along the surface of the ceiling U because the speed of the passing air drops.

With respect to this, in the indoor unit 4 of the air conditioning apparatus 1 of the present embodiment, as shown in FIG. 15, while the posture of the flap body 80 is adjusted in such a way that the front surface 80*x* of the flap body 80 during the individual air volume suppression control faces the upstream side of the first long-side air outlet flow path 51*a* etc., the distance between the outside wall surface of the first long-side air outlet flow path 51*a* and the flap body 80 becomes narrower (see S1 in FIG. 15). Consequently, the volume of air flowing out from the long-side air outlet 50 on which the individual air volume suppression control is being performed and staying in the neighborhood of the ceiling U can be reduced so that ceiling dirtying can be suppressed.

(5)

In the indoor unit 4 of the air conditioning apparatus 1 of the present embodiment, the flap body 80 during the individual air volume suppression control is in a state where the back surface 80*y* side on which the flocked sheet 80*ya* is disposed faces the room side, and the front surface 80*x* side that has a flat shape cannot be directed toward the room side. However, during the individual air volume suppression control, the flap body 80 is not in the exit of the first long-side air outlet flow path 51*a* etc. but in a slightly deep-set position, so it becomes difficult for the back surface 80*y* of the flap body 80 to be able to be seen, and the placement is such that if is difficult to see the inside of the indoor unit 4, so the design can be improved.

<7> Other Embodiments (A)

In the above embodiment, a case of suppressing the volume of air blown out from the long-side air outlet 50 specified when receiving an instruction from the user to perform the individual air volume suppression control was taken as an example and described.

However, the present invention is not limited to this and may also, for example, be configured to perform control that not only suppresses the volume of air blown out from the long-side air outlet 50 specified when receiving an instruction from the user to perform the individual air volume suppression control but at the same time also reduces the air volume of the indoor fan 41 so as make it substantially inversely proportional to the number of the long-side air outlets 50 on which the individual air volume suppression control is being performed.

Because of this, in a case where the volume of air supplied to a specific user has been reduced, the volume of air supplied to another user can be prevented from unintentionally ending up increased.

(B)

In the above embodiment, a case where, in the independent airflow direction control, the airflow direction adjusting drive units 95 cause the airflow direction adjusting portions 70 to rotate was taken as an example and described.

However, the present invention is not limited to this and may also, for example, be configured to change, in the independent airflow direction control, the upper limit and the lower limit of the swinging angle per each of the airflow direction adjusting portions 70 whose rotation the airflow direction adjusting drive units 95 control in a case where, for example, there is an input via the controller 7*c* from the user or in the case of performing a predetermined operating mode.

Because of this, the airflow direction adjusting drive units 95 do not put the airflow direction adjusting portions 70 in a state in which the airflow direction adjusting portions 70 virtually stop the air blown out from the long-side air outlets 50 as a result of the individual air volume suppression control being performed, but the airflow direction adjusting drive units 95 can cause the airflow direction adjusting portions 70 to swing in avoidance of a section where a user who dislikes the sensation of a draft is positioned, and it also becomes possible to maintain the comfort of another user in the area around the user who dislikes the sensation of a draft.

(C)

In the above embodiment, a case of significantly suppressing the volume of air blown out from the long-side air outlet 50 for which an instruction to perform the individual air volume suppression control has been received was taken as an example and described.

However, the present invention is not limited to this; for example, the control unit 7 may, in regard to the posture of the flap body 80 in the long-side air outlet 50 for which an instruction to perform the individual air volume suppression control has been received, perform control that intermittently releases, at appropriate time intervals, the posture in which the flap body 80 suppresses the air volume, such as, for example, using the airflow direction adjusting drive units 95 to put the flap body 80 in a posture in which the flap body 80 suppresses the air volume for a predetermined amount of time and thereafter causing the flap body 80 to perform an ordinary swing operation during another predetermined amount of time.

(D)

In the above embodiment, a case where the number of the long-side air outlets 50 on which the individual air volume suppression control can be simultaneously performed is determined to be two or less and the control unit 7 performs control was taken as an example and described.

However, the present invention is not limited to this; for example, the control unit 7 may also perform control in such a way that the number of the long-side air outlets 50 on which the individual air volume suppression control can be simultaneously performed is just one.

Further, in a case where there are more than four air outlets in which flaps that can adjust the airflow direction are placed, the present invention may be configured in such a way that it can simultaneously perform the individual air volume suppression control on up to 50% of those or may be configured in such a way that it can simultaneously perform the individual air volume suppression control on up to 25%) individually.

(E)

In the above embodiment, the indoor unit 4 that blows out conditioned air in eight directions was taken as an example and described.

However, the present invention is not limited to this and may also have a configuration where, for example, in the above embodiment, the short-side air outlets 60 are not disposed and the blow-out directions are only those of the four long-side air outlets 50. Further, the indoor unit may also be one where there are two air outlets.

INDUSTRIAL APPLICABILITY

According to the present invention, the volume of air blown out from any air outlet of plural air outlets can be reduced while suppressing dew condensation without using a new part, so the present invention is particularly useful in an indoor unit of air conditioning apparatus.

What is claimed is:

1. An indoor unit of an air conditioning apparatus that is fixed with respect to a ceiling, the indoor unit comprising:

an indoor unit casing having a downwardly facing air inlet and plural air outlets laterally surrounding a circumference of the air inlet;

plural airflow direction adjusting plates disposed in the air outlets, respectively, the airflow direction adjusting plates being configured to rotate in order to adjust the airflow direction of conditioned air blown out from the air outlets, respectively; and an airflow direction adjusting control unit configured to independently adjust rotational states of the plural airflow direction adjusting plates, respectively, the airflow direction adjusting control unit being further configured to position a body of at least one of the plural airflow direction adjusting plates in a postural state inside a corresponding one of the air outlets so that a first gap is formed between a first wall surface of an air outlet flow path leading to the air outlet and an end portion on an upper side of the body, the first wall surface being disposed on a side opposite to an air inlet side of the air outlet flow path, a second gap is formed between a second wall surface of the air outlet flow path leading to the air outlet and an end portion on a lower side of the body, the second wall surface being disposed on the air inlet side of the air outlet flow path closer to the air inlet than the first wall surface, the first gap is smaller than the second gap, the end portion on the lower side of the body is positioned more on an airflow upstream side in the air outlet flow path than the air outlet, the end portion on the upper side of the body is closer to the first wall surface than the end portion on the lower side of the body, a projecting front surface of the body faces the airflow upstream side of the air outlet flow path, and a recessed back surface facing an airflow downstream side of the air outlet flow path, and the airflow direction adjusting control unit being further configured to maintain the body of the airflow direction adjusting plate in the postural state in an air volume reducing state in which the airflow direction adjusting plate reduces a volume of the conditioned air passing through the corresponding one of the air outlets or a suppressing state in which the airflow direction adjusting plate suppresses a flow of the conditioned air heading from the corresponding one of the air outlets toward an opposite side relative to an air inlet side.

2. The indoor unit of an air conditioning apparatus according to claim 1, further comprising arm members that extend from the airflow direction adjusting plates to rotating shafts so that the airflow direction adjusting plates are placed away from the rotating shafts, respectively.

3. The indoor unit of an air conditioning apparatus according to claim 2, wherein the recessed back surface has a dew condensation suppressing surface with a groove shape formed therein or being flocked in order to suppress dew condensation, and the projecting front surface has a flatter shape than the dew condensation suppressing surface.

4. The indoor unit of an air conditioning apparatus according to claim 3, wherein the recessed back surface has a concave shape, and the projecting front surface has a convex shape.

5. The indoor unit of an air conditioning apparatus according to claim 2, wherein the indoor unit is equipped with at least four sets of the airflow direction adjusting plates and the air outlets, and the airflow direction adjusting control unit is further configured to simultaneously execute the air volume reducing state or the suppressing state on only one set or two sets of the four sets.

6. The indoor unit of an air conditioning apparatus according to claim 2, wherein the end portion on the upper side of the body is located above the rotating shaft of the airflow direction adjusting plate when the body of the airflow adjusting plate is in the postural state, and the lower side of the body is located below the rotating shaft of the airflow direction adjusting plate when the body of the airflow adjusting plate is in the postural state.

7. The indoor unit of an air conditioning apparatus according to claim 1, wherein the recessed back surface has a dew condensation suppressing surface with a groove shape formed therein or being flocked in order to suppress dew condensation, and the projecting front surface has a flatter shape than the dew condensation suppressing surface.

8. The indoor unit of an air conditioning apparatus according to claim 7, wherein the recessed back surface has a concave shape, and the projecting front surface has a convex shape.

9. The indoor unit of an air conditioning apparatus according to claim 8, wherein the indoor unit is equipped with at least four sets of the airflow direction adjusting plates and the air outlets, and the airflow direction adjusting control unit is further configured to simultaneously execute the air volume reducing state or the suppressing state on only one set or two sets of the four sets.

10. The indoor unit of an air conditioning apparatus according to claim 7, wherein the indoor unit is equipped with at least four sets of the airflow direction adjusting plates and the air outlets, and the airflow direction adjusting control unit is further configured to simultaneously execute the air volume reducing state or the suppressing state on only one set or two sets of the four sets.

11. The indoor unit of an air conditioning apparatus according to claim 1, wherein the indoor unit is equipped with at least four sets of the airflow direction adjusting plates and the air outlets, and the airflow direction adjusting control unit is further configured to simultaneously execute the air volume reducing state or the suppressing state on only one set or two sets of the four sets.

12. The indoor unit of an air conditioning apparatus according to claim 1, wherein the air outlet is not closed by the airflow direction adjusting plate in the air volume reducing state or in the suppressing state.

13. The indoor unit of an air conditioning apparatus according to claim 1, wherein the airflow direction adjusting control unit is further configured to position the body of the at least one of the plural airflow direction adjusting plates inside the corresponding one of the air outlets so that the first gap is formed between the first wall surface of the air outlet flow path leading to the air outlet on the side opposite to the air inlet side and the end portion on the upper side of the body, the second gap is formed between the second wall surface of the air outlet flow path leading to the air outlet on the air inlet side and the end portion on the lower side of the body, the first gap is smaller than the second gap, the end portion on the lower side of the body is positioned more on the airflow upstream side in the air outlet flow path than the air outlet with the projecting front surface of the body facing the airflow upstream side of the air outlet flow path and the recessed back surface facing the airflow downstream side of the air outlet flow path to thereby put the airflow direction adjusting plate in the suppressing state in which the airflow direction adjusting plate suppresses a flow of the conditioned air heading from the corresponding one of the air outlets toward an opposite side relative to an air inlet side.

* * * * *